US008182075B2

(12) United States Patent
Ishizawa et al.

(10) Patent No.: US 8,182,075 B2
(45) Date of Patent: May 22, 2012

(54) LIQUID DELIVERY SYSTEM AND MANUFACTURING METHOD THEREOF

(75) Inventors: Taku Ishizawa, Shiojiri (JP); Satoshi Shinada, Shiojiri (JP); Chiaka Miyajima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 404 days.

(21) Appl. No.: 12/496,936

(22) Filed: Jul. 2, 2009

(65) Prior Publication Data

US 2010/0013896 A1 Jan. 21, 2010

(30) Foreign Application Priority Data

Jul. 15, 2008 (JP) ..... 2008-184155

(51) Int. Cl.
*B41J 2/175* (2006.01)

(52) U.S. Cl. ..... 347/85; 347/86

(58) Field of Classification Search ..... 347/84, 347/85, 86

See application file for complete search history.

(56) References Cited

U.S. PATENT DOCUMENTS

| | | | | |
|---|---|---|---|---|
| 636,691 | A * | 11/1899 | Liu | 74/347 |
| 716,535 | A * | 12/1902 | Ota et al. | 493/287 |
| 6,386,691 | B1 * | 5/2002 | Liu | 347/85 |
| 6,585,358 | B2 | 7/2003 | Usui et al. | |
| 7,165,835 | B2 * | 1/2007 | Ota et al. | 347/86 |
| 7,182,446 | B2 | 2/2007 | Usui et al. | |
| 7,188,936 | B2 | 3/2007 | Usui et al. | |
| 7,942,510 | B2 * | 5/2011 | Shinada et al. | 347/86 |
| 2007/0109369 | A1 | 5/2007 | Usui et al. | |
| 2008/0036805 | A1 | 2/2008 | Shinada et al. | |
| 2008/0036806 | A1 | 2/2008 | Shinada et al. | |
| 2008/0036808 | A1 | 2/2008 | Shinada et al. | |
| 2008/0036833 | A1 | 2/2008 | Shinada et al. | |
| 2009/0015644 | A1 | 1/2009 | Shinada et al. | |
| 2009/0167827 | A1 | 7/2009 | Usui et al. | |
| 2009/0237469 | A1 | 9/2009 | Miyajima et al. | |
| 2009/0237473 | A1 | 9/2009 | Miyajima et al. | |
| 2009/0295885 | A1 | 12/2009 | Wanibe | |

FOREIGN PATENT DOCUMENTS

| | | | |
|---|---|---|---|
| CN | 101121336 | A | 2/2008 |
| EP | 1886823 | * | 2/2008 |
| JP | 07-117236 | A | 5/1995 |
| JP | 2000-085138 | A | 3/2000 |
| JP | 2004-009450 | A | 1/2004 |
| JP | 2005-059322 | A | 3/2005 |
| JP | 2006-248202 | A | 9/2006 |
| JP | 2006-305942 | A | 11/2006 |
| JP | 2007-253328 | A | 10/2007 |
| KR | 2001-0082671 | A | 8/2001 |
| KR | 2008-0014666 | A | 2/2008 |

* cited by examiner

*Primary Examiner* — Anh T. N. Vo

(74) *Attorney, Agent, or Firm* — Stroock & Stroock & Lavan LLP

(57) ABSTRACT

The liquid delivery system is equipped with a liquid container that is installable on the liquid jetting device, a liquid supply device, and a liquid flow passage member. The liquid container is equipped with a recess portion having an opening provided on a first surface, a container main unit having a liquid delivery portion for delivering liquid to the liquid jetting device, and a sealing film that seals the opening of the recess portion to define together with an inner surface of the recess portion a chamber and a inner flow passage at an upstream side of the liquid delivery portion. The liquid flow passage member is connected to at least one of the chamber and the inner flow passage via a hole provided on the sealing film.

6 Claims, 18 Drawing Sheets

LIQUID DELIVERY SYSTEM AND MANUFACTURING METHOD THEREOF

CROSS-REFERENCE TO RELATED APPLICATION

The present application claims the priority based on Japanese Patent Application No. 2008-184155 filed on Jul. 15, 2008, the disclosure of which is hereby incorporated by reference in its entirety.

BACKGROUND

1. Technical Field

The present invention relates to a liquid delivery system that delivers liquid to a liquid jetting device and the manufacturing method thereof.

2. Related Art

Known as a liquid jetting device is an inkjet printer, for example. Ink is delivered from an ink cartridge to the inkjet printer. In the past, known was a technology whereby a large capacity ink tank was additionally installed on the outside of the inkjet printer, and by connecting this ink tank and ink cartridge using a tube, the ink storage volume was increased (see JP-A-2006-305942, for example). With this technology, a hole opening process was implemented by cutting the resin case that constitutes the ink cartridge, and the tube was connected to that hole.

However, there has been a demand for technology that would simplify or omit the processes in relation to this kind of ink cartridge. This kind of problem is not limited to inkjet printers, and is typically a problem common to liquid jetting devices or liquid consumption devices for which it is possible to install a liquid container.

SUMMARY

An object of the invention is to provide technology for easily delivering liquid from outside to a liquid jetting device for which it is possible to install a liquid container.

According to an aspect of the invention, there is provided a liquid delivery system for delivering liquid to a liquid jetting device. the liquid delivery system comprises: a liquid container that is installable on the liquid jetting device; a liquid supply device that supplies the liquid to the liquid container; and a liquid flow passage member that connects the liquid supply device with the liquid container, wherein the liquid container has: a container main unit that includes a recess portion having an opening on a first surface of the liquid container, and a liquid delivery portion that supplies the liquid to the liquid jetting device; and a sealing film that seals the opening of the recess portion to define together with an inner surface of the recess portion a chamber and a inner flow passage at an upstream side of the liquid delivery portion, wherein the liquid flow passage member is connected to at least one of the chamber and the inner flow passage via a hole provided on the sealing film. With this arrangement, it is possible to easily connect the liquid container to the liquid flow passage member without processing the hole in the container main unit.

In a possible arrangement in the liquid delivery system of the above aspect, the liquid container may further comprise a cover member that covers the sealing film, and the liquid flow passage member may pierce through a hole provided on the cover member. With this arrangement, it is possible to suppress deformation of the liquid flow passage member using the cover member.

In another possible arrangement in the liquid delivery system of the above aspect, the liquid flow passage member may be affixed to the cover member. With this arrangement, it is possible to suppress the liquid flow passage member from falling off or the like.

In yet another possible arrangement in the liquid delivery system of the above aspect, the liquid container may further comprise a sensor for detecting the presence or absence of the liquid at a first position of the inner flow passage, and the liquid flow passage member may be connected to the at least one of the chamber and the inner flow passage at an upstream side from the first position. With this arrangement, it is possible to detect when liquid is being depleted with the liquid supply system using the sensor.

In yet another possible arrangement in the liquid delivery system of the above aspect, the liquid container may further comprise a valve member arranged at a second position of the inner flow passage, for adjusting the pressure difference of the upstream side and downstream side of the second position, and the liquid flow passage member may be connected to the at least one of the chamber and the inner flow passage at an upstream side from the second position. With this arrangement, it is possible to deliver liquid to the liquid consumption device at a suitable pressure using the differential pressure valve function.

In yet another possible arrangement, the liquid delivery system of the above aspect may further comprise a seal member that makes a liquid-tight seal between the sealing film and the liquid flow passage member. With this arrangement, it is possible to suppress leaking of liquid from between the sealing film and the liquid flow passage member.

There are various possible modes of working the invention, including but not limited to a liquid delivery system and a method of manufacturing the same; a liquid receptacle for use in a liquid delivery system and a method of manufacturing the same; and a liquid jetting device or a liquid consuming device, for example.

These and other objects, features, aspects, and advantages of the invention will become more apparent from the following detailed description of the preferred embodiments with the accompanying drawings.

DESCRIPTION OF THE PREFERRED EMBODIMENTS

The embodiments of the invention will be described in the order indicated below.

A. Overall Configuration of Ink Delivery System

B. Basic Configuration of Ink Cartridge

C. Configuration of Ink Cartridge for Use in Ink Delivery System and Method of Manufacturing the Same D. Other Modified Examples

A. Overall Configuration of Ink Delivery System

Figure 1A:
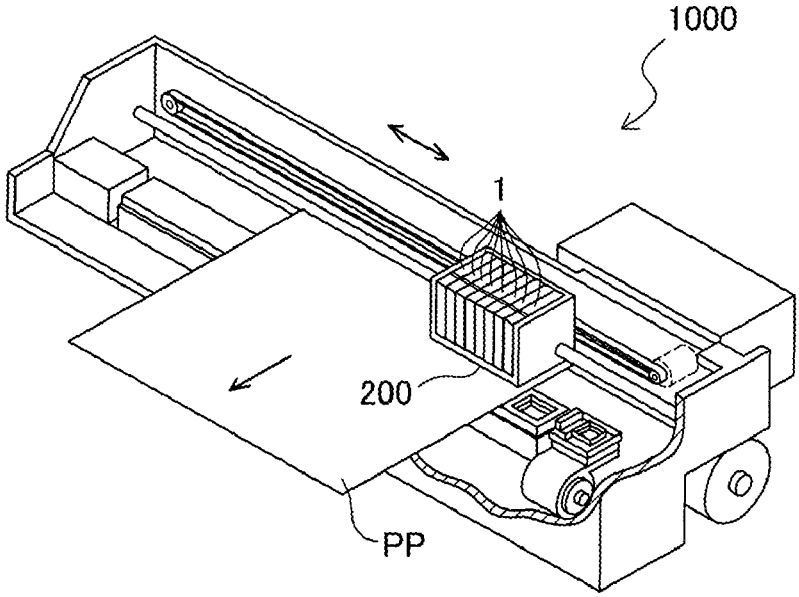
FIGS. 1A and 1B show an example of an on-cartridge type ink-jet printer and an ink delivery system employing the same.

FIG. 1A is a perspective view depicting an exemplary ink-jet printer. This ink-jet printer 1000 has a carriage 200 that travels in the main scanning direction, as well as a feed mechanism for feeding printing paper PP in the sub-scanning direction. A print head (not shown) is disposed at the lower end of the carriage 200, and this print head is used to carry out printing on the printing paper PP. A cartridge housing capable of accommodating multiple ink cartridges 1 is provided on the carriage 200. This kind of printer, in which the ink cartridges are installed on the carriage, is termed an "on-carriage type printer."

Figure 1B:
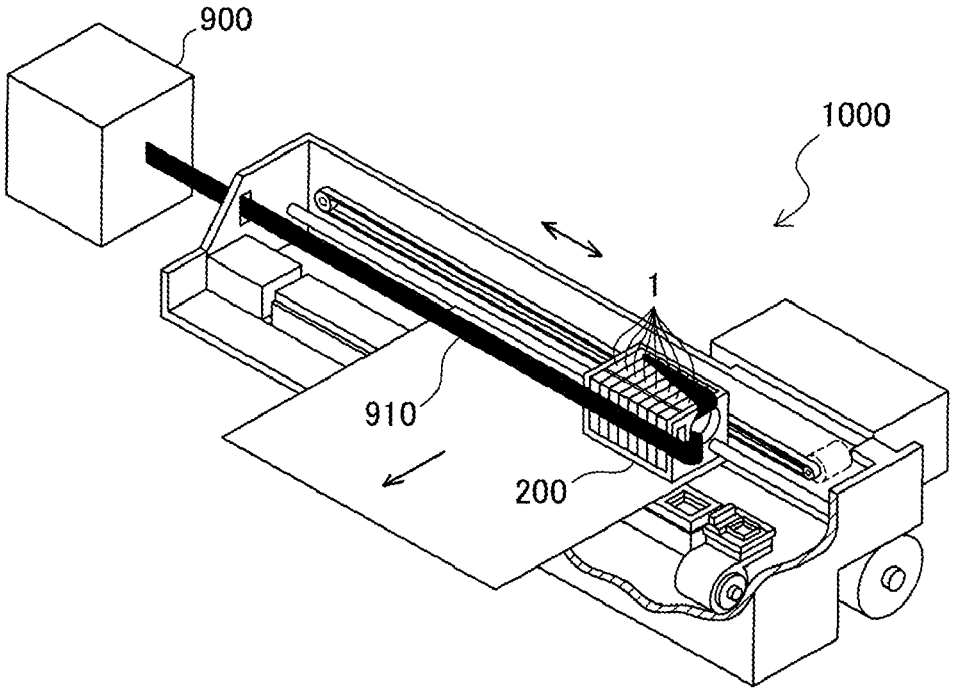

FIG. 1B depicts an ink delivery system that employs this ink-jet printer 1000. In this system, large-capacity ink tank 900 is provided externally to the ink-jet printer 1000, with the large-capacity ink tank 900 and the ink cartridges 1 being connected by ink supply tubes 910. The large-capacity ink tank 900 contains ink receptacles equal in number to the number of ink cartridges 1. By providing this additional large-capacity ink tank 900, the ink storage capacity of the printer can be substantially increased appreciably. The large-capacity ink tank 900 is also referred to as an "external ink tank."

Figure 2A:
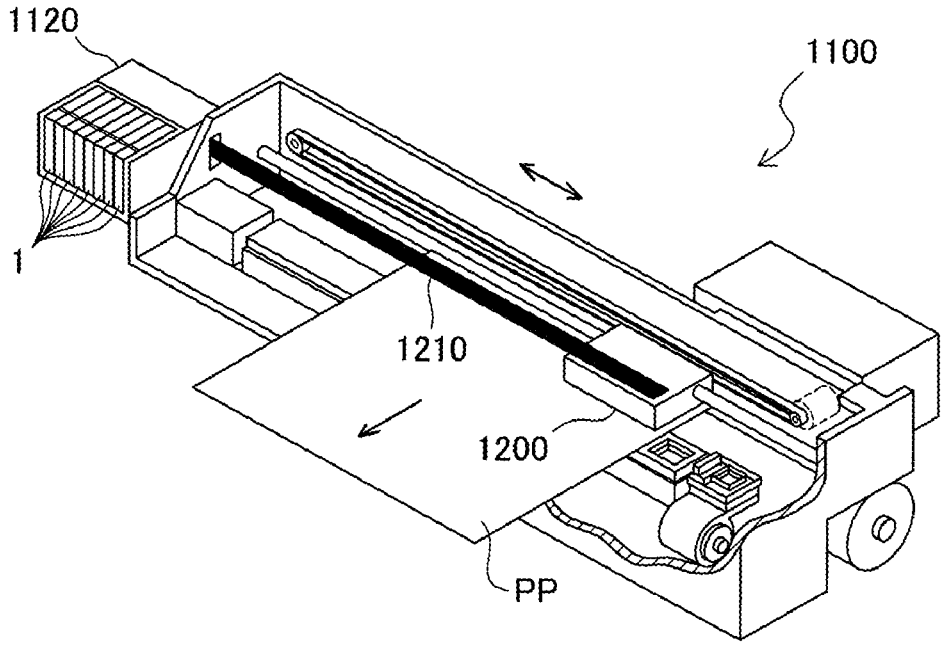
FIGS. 2A and 2B show an example of an off-cartridge type ink-jet printer and an ink delivery system employing the same.

FIG. 2A is a perspective view depicting another exemplary ink-jet printer. In this ink-jet printer 1110, the ink cartridges are not installed on the carriage 1200, but rather are disposed in a cartridge housing 1120 to the outside of the printer chassis (to the outside of the range of travel of the carriage). The ink cartridges 1 and the carriage 1200 are connected by ink delivery tubes 1210. This kind of printer, in which the ink cartridges are installed at a location other than the carriage, is termed an "off-carriage type printer."

Figure 2B:
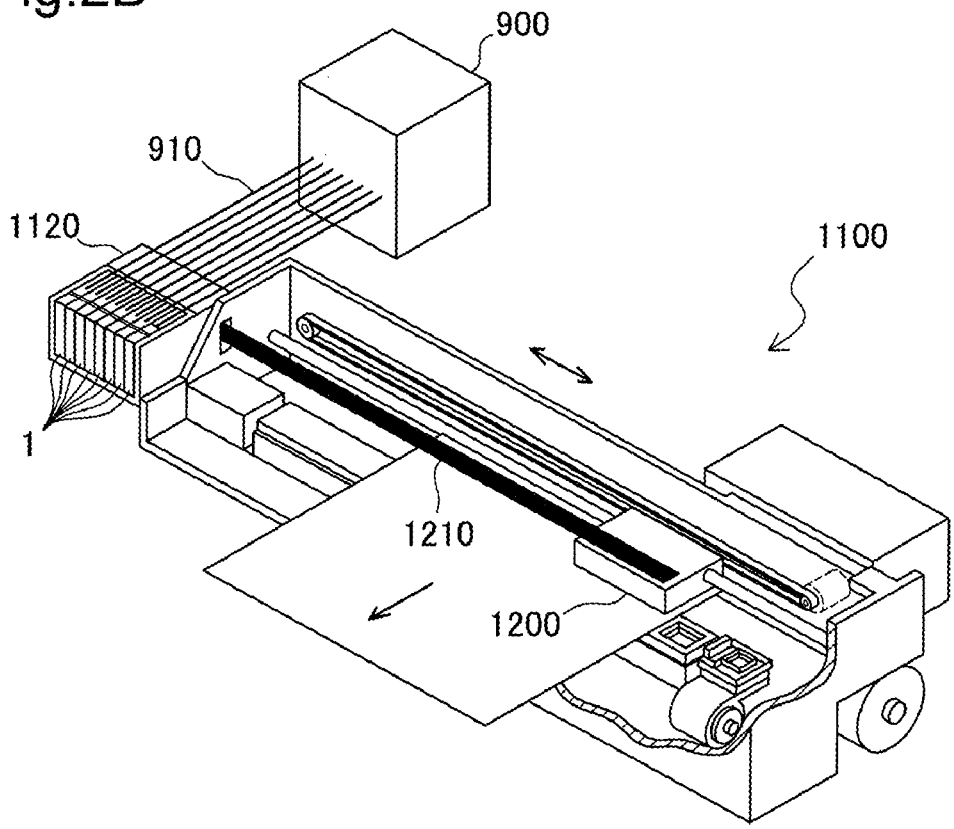

FIG. 2B depicts an ink delivery system that employs this ink-jet printer 1100. In this system, an additional large-capacity ink tank 900 is provided, and the large-capacity ink tank 900 and the ink cartridges 1 are connected by ink supply tubes 910. Thus, for this type of off-carriage printer as well, by the same method as with the on-carriage type printer it will be possible to design an ink delivery system having appreciably larger ink storage capacity.

Herein the system composed of the ink cartridges 1, the large-capacity ink tank 900, and the ink supply tubes 910 will be referred to as the "ink delivery system." In some instances, the entire system inclusive of the ink-jet printer will be referred to as the "ink delivery system."

Following is a description first of the design of the ink cartridges that are utilized in the embodiments of the ink delivery system herein; followed by a description of the detailed configuration of the ink delivery system and of a method for manufacturing it. While the following description relates for the most part to the use of an on-carriage type printer, the specifics thereof are applicable analogously to an ink-jet printer of off-carriage type.

B. Basic Configuration of Ink Cartridge

Figure 3:
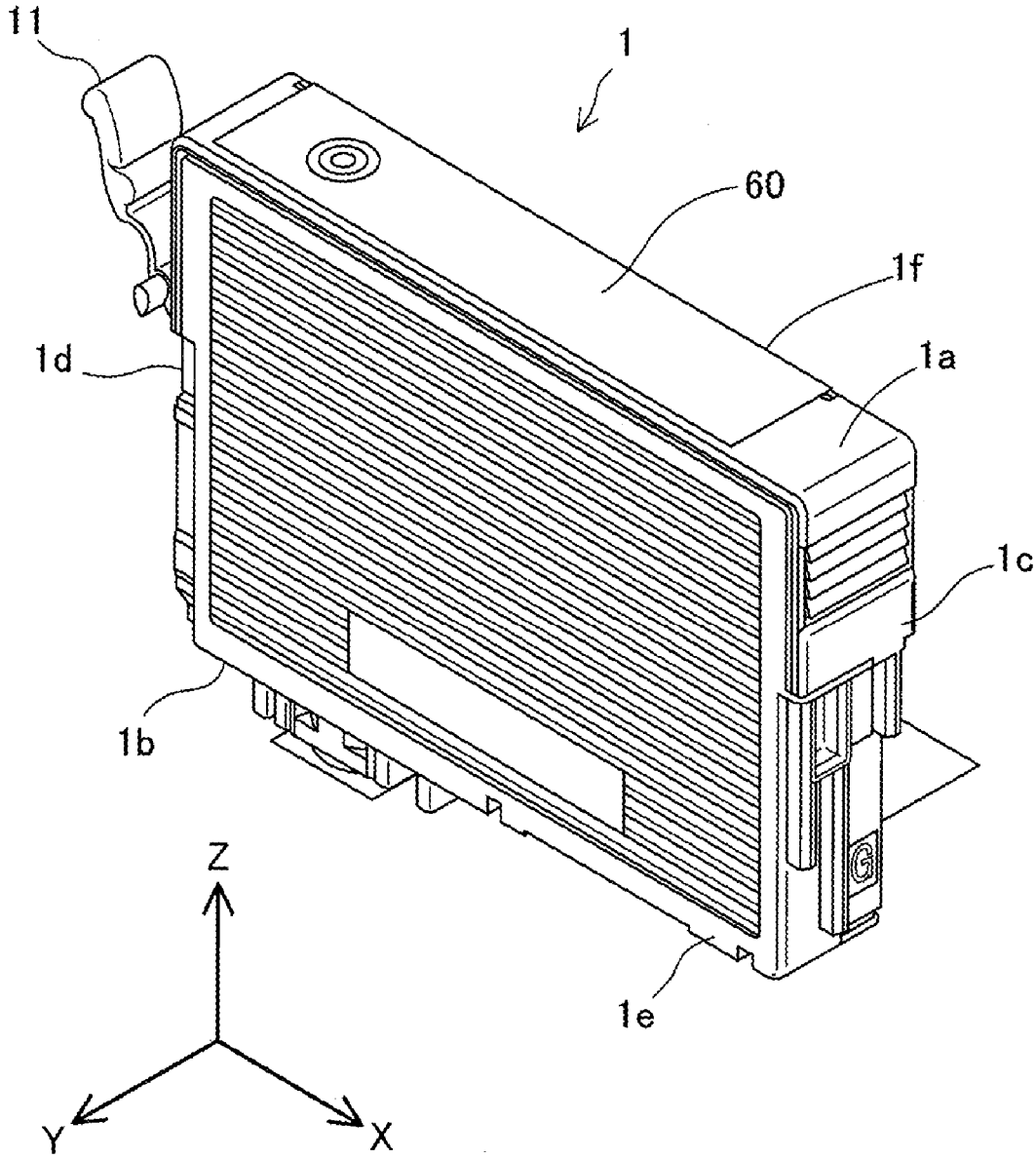
FIG. 3 is a first external perspective view of an ink cartridge.
Figure 4:
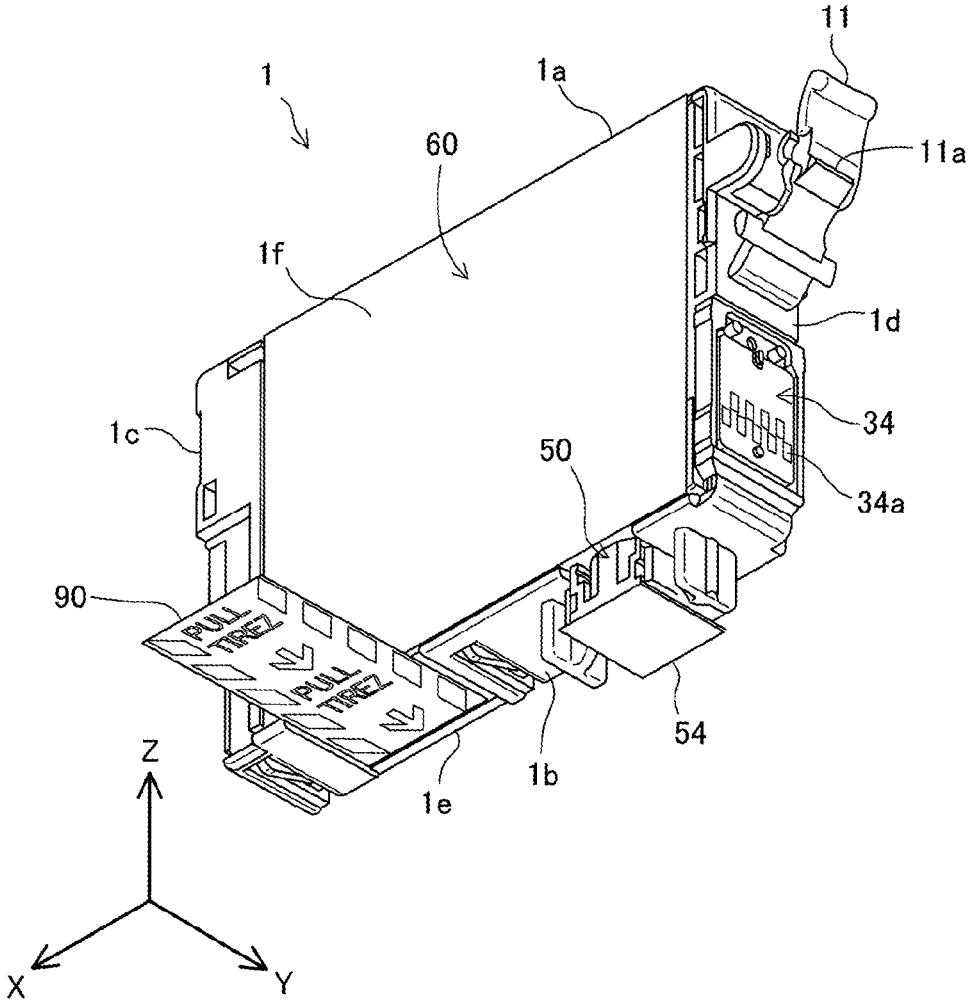
FIG. 4 is a second external perspective view of an ink cartridge.
Figure 5:
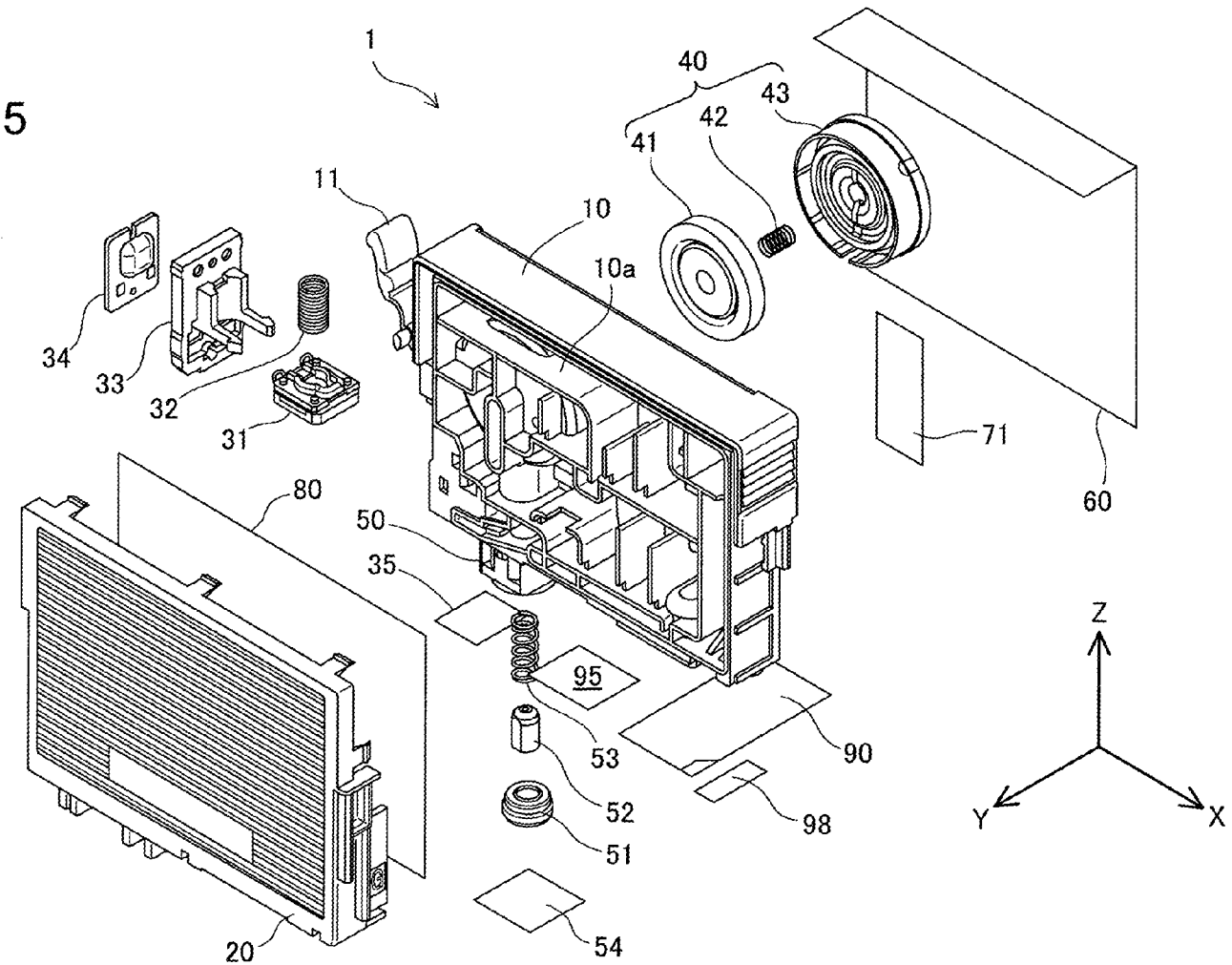
FIG. 5 is a first exploded perspective view of an ink cartridge.
Figure 6:
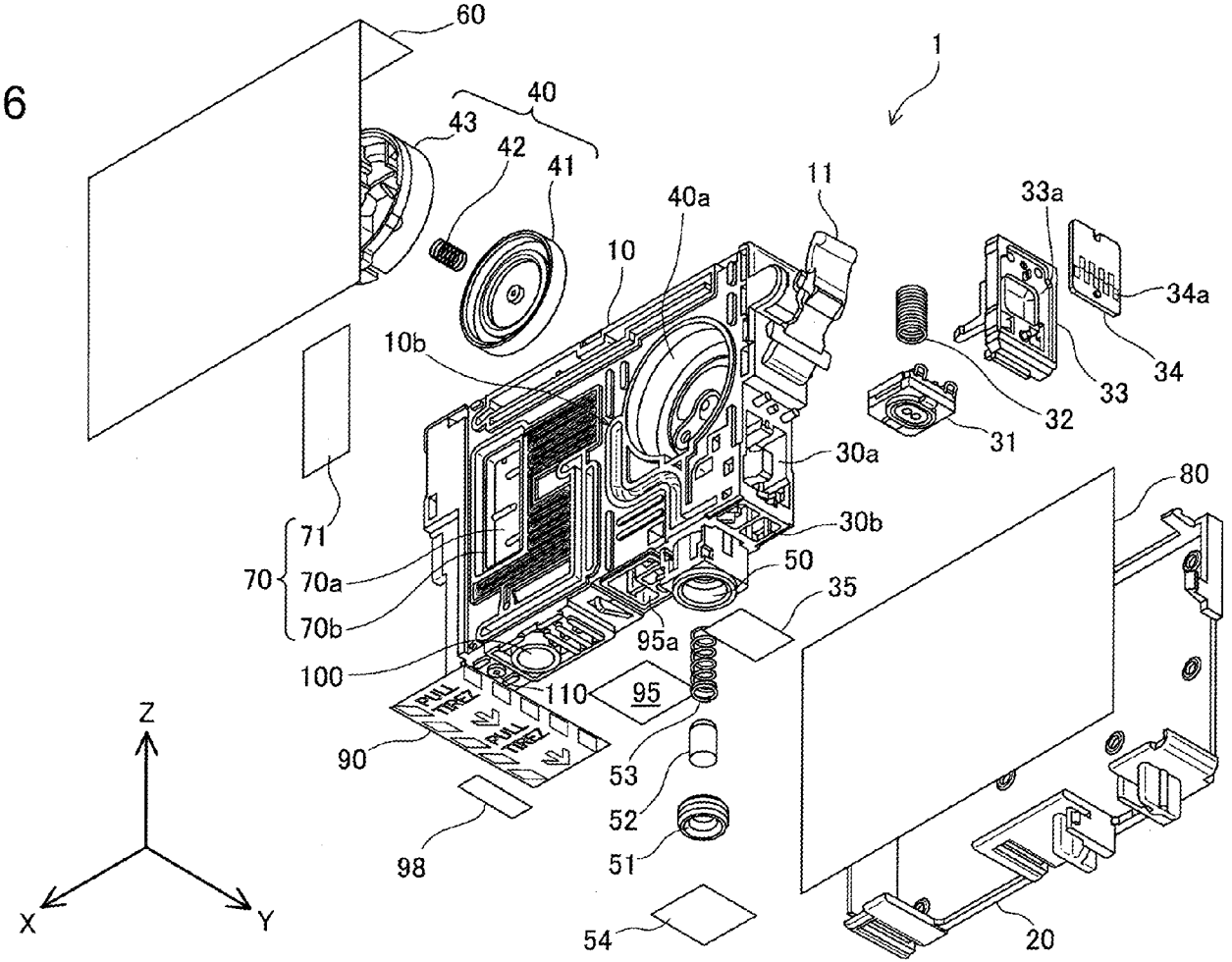
FIG. 6 is a second exploded perspective view of an ink cartridge.
Figure 7:
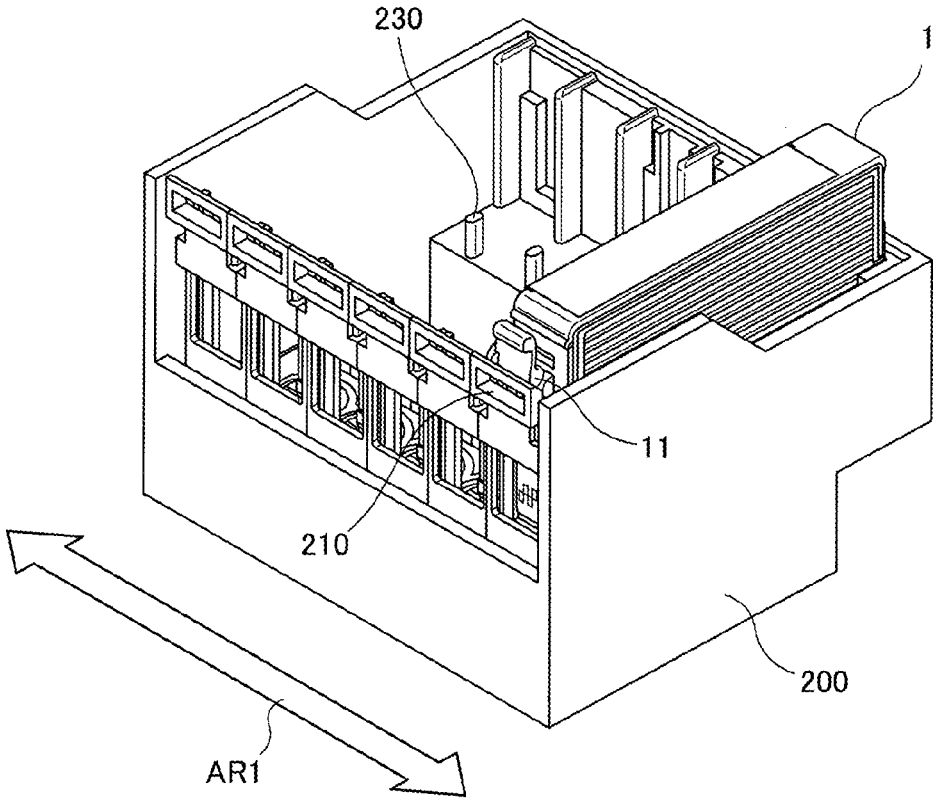
FIG. 7 is a drawing depicting an ink cartridge installed on a carriage.

FIG. 3 is a first external perspective view of an ink cartridge. FIG. 4 is a second external perspective view of an ink cartridge. FIG. 4 depicts the cartridge of FIG. 3 viewed from the opposite direction. FIG. 5 is a first exploded perspective view of an ink cartridge. FIG. 6 is a second exploded perspective view of an ink cartridge. FIG. 6 depicts the cartridge of FIG. 5 viewed from the opposite direction. FIG. 7 depicts an ink cartridge installed in the carriage 200. In FIGS. 3 to 6, the X, Y, and Z axes are shown in order to identify direction.

The ink cartridge 1 stores liquid ink inside. As depicted in FIG. 7, the ink cartridge 1 installed on the carriage 200 of the ink-jet printer, and delivers ink to the print head of the ink-jet printer.

As depicted in FIGS. 3 and 4, the ink cartridge 1 has generally rectangular parallelepiped contours, and has a Z-axis positive direction face 1*a*, a Z-axis negative direction face 1*b*, an X-axis positive direction face 1*c*, an X-axis negative direction face 1*d*, a Y-axis positive direction face 1*e*, and a Y-axis negative direction face 1*f*. For convenience, hereinbelow face 1*a* will be termed the top face, face 1*b* the bottom face, face 1*c* the right face, face 1*d* the left face, face 1*e* the front face, and face 1*f* the back face. The sides on which these faces 1*a* to 1*f* are located will be respectively termed the top face side, the bottom face side, the right face side, the left face side, the front face side, and the back face side.

On the bottom face 1*b* there is disposed a liquid delivery port 50 having a delivery hole for delivering ink to the ink-jet printer. Also, an air vent hole 100 for introducing air into the ink cartridge 1 opens onto the bottom face 1*b* (FIG. 6).

The air vent hole 100 has a depth and diameter such that a projection 230 (FIG. 7) that has been formed on the carriage 200 of the ink-jet printer will fit within it, with enough latitude to have a prescribed gap. The user will peel off a sealing film 90 that airtightly seals the air vent hole 100, then install the ink cartridge 1 on the carriage 200. The projection 230 is provided in order to prevent the user from forgetting to peel off the sealing film 90.

As depicted in FIGS. 3 and 4, a locking lever 11 is disposed on the left face 1*d*. A projection 11*a* is formed on the locking lever 11. During installation on the carriage 200, the projection 11*a* will lock in a recess 210 that has been formed on the carriage 200, thereby securing the ink cartridge 1 to the carriage 200 (FIG. 7). As will be appreciated from the above, the carriage 200 constitutes an installation portion on which the ink cartridges 1 are installed. During printing by the ink-jet printer, the carriage 200, in unison with the print head (not shown), undergoes reciprocating motion across the width of the printing medium in the main scanning direction. The main scanning direction is indicated by arrow AR1 in FIG. 7. Specifically, when the ink-jet printer carries out printing the ink cartridges 1 will be undergo reciprocating motion in the Y direction in the drawings.

A circuit board 34 is disposed to the lower side of the locking lever 11 on the left face 1*d* (FIG. 4). Several electric terminals 34 have been formed on the circuit board 34; these electric terminals 34 electrically connect to the ink-jet printer via electric terminal pins (not shown) provided on the carriage 200.

An outer surface film 60 is adhered to the top face 1*a* and the back face 1*f* of the ink cartridge 1.

The internal configuration and configuration of parts of the ink cartridge 1 will be described with reference to FIGS. 5 and 6. The ink cartridge 1 has a cartridge body 10, and a cover member 20 covering the front face side of the cartridge body 10.

Ribs 10*a* of various shapes have been formed on the front face side of the cartridge body 10 (FIG. 5). A film 80 that covers the front face side of the cartridge body 10 is positioned between the cartridge body 10 and the cover member 20. The film 80 is adhered carefully to the edge faces on the front face side of the ribs 10*a* of the cartridge body 10 so as to prevent gaps from forming. The ribs 10*a* and the film 80 serve to divide the interior of the ink cartridge 1 into a plurality of small chambers, for example, ink storage chambers and a buffer chamber. These chambers will be discussed in more detail later.

A differential pressure valve housing chamber 40*a* and a vapor-liquid separation chamber 70*a* are formed to the back face side of the cartridge body 10 (FIG. 6). The differential pressure valve housing chamber 40*a* houses a differential pressure valve 40, which includes a valve member 41, a spring 42, and a spring seat 43. A ledge 70*b* is formed on the inner wall that encloses the bottom face of the vapor-liquid separation chamber 70*a*, and a vapor-liquid separation membrane 71 is adhered to the ledge 70*b*; this arrangement in its entirety constitutes a vapor-liquid separation filter 70.

A plurality of grooves 10*b* are also formed to the back face side of the cartridge body 10 (FIG. 6). When the outer surface film 60 is disposed so as to cover substantially the entire back face side of the cartridge body 10, these grooves 10*b* will define various flow passages (discussed later) between the cartridge body 10 and the outer surface film 60, for example, flow channels through which ink and air may flow.

Next, the arrangement in the vicinity of the circuit board 34 mentioned earlier will be described. A sensor housing chamber 30*a* is formed to the lower face side of the right face of the cartridge body 10 (FIG. 6). The sensor housing chamber 30*a* houses a liquid level sensor 31 and a fastening spring 32. The fastening spring 32 fastens the liquid level sensor 31 by pushing it against the inside wall on the lower face side of the sensor housing chamber 30*a*. An opening on the right face side of the sensor housing chamber 30*a* is covered by a cover member 33, and the circuit board 34 mentioned earlier is fastened to the outside face 33*a* of the cover member 33. The sensor housing chamber 30*a*, the liquid level sensor 31, the fastening spring 32, the circuit board 34, and a sensor flow passage forming chamber 30*b*, discussed later, will be referred to as the sensor section 30.

While not illustrated in detail, the liquid level sensor 31 includes a cavity that defines part of the intermediate flow passage (to be discussed later); an oscillating plate that defines part of the wall of the cavity; and a piezoelectric element arranged on the oscillating plate. The terminals of the piezoelectric element are connected electrically to some of the electric terminals of the circuit board 34; and with the ink cartridge 1 installed in the ink-jet printer, the terminals of the piezoelectric element will be electrically connected to the ink-jet printer via electric terminals of the circuit board 34. By applying electrical energy to the piezoelectric element, the ink-jet printer can induce oscillation of the oscillating plate through the agency of the piezoelectric element. The presence of any air bubbles in the cavity will be ascertained through subsequent detection, through the agency of the piezoelectric element, of a characteristic (frequency etc.) of residual vibration of the oscillating plate. Specifically, when due to consumption of the ink stored in the cartridge body 10, the state inside the cavity changes from an ink-filled state to an air-filled state, there will be a change in the characteristics of residual vibration of the oscillating plate. By detecting this change in characteristics of residual vibration via the liquid level sensor 31, the ink-jet printer detects whether ink is present in the cavity.

The circuit board 34 is provided with a rewritable nonvolatile memory such as EEPROM (Electronically Erasable and Programmable Read Only Memory), which is used to store parameters such as the amount of ink consumed by the ink-jet printer.

On the bottom face side of the cartridge body 10 there are disposed the liquid delivery port 50 and the air vent hole 100 mentioned previously, as well as a depressurization hole 110, a sensor flow passage forming chamber 30*b*, and a labyrinthine passage forming chamber 95*a* (FIG. 6). The depressurization hole 110 is utilized during injection of the ink in the ink cartridge 1 manufacturing process, in order to suck out air and depressurize the interior of the ink cartridge 1. The sensor flow passage forming chamber 30*b* and the labyrinthine passage forming chamber 95*a* constitute parts of the intermediate flow passage, discussed later. The sensor flow passage forming chamber 30*b* and the labyrinthine passage forming chamber 95*a* are the sections that are narrowest and have the highest flow resistance in the intermediate flow passage. In particular, the labyrinthine passage forming chamber 95 defines a flow passage of labyrinthine configuration, and produces a meniscus (a liquid bridge that forms in the flow passage), and therefore the flow resistance is particularly high in this section.

The openings of the liquid delivery port 50, the air vent hole 100, the depressurization hole 110, the labyrinthine passage forming chamber 95*a*, and the sensor flow passage forming chamber 30*b* will be respectively sealed off by sealing films 54, 90, 98, 95, 35 upon completion of manufacture of the ink cartridge 1. Of these, the sealing film 90 is intended to be peeled off by the user prior to installing the ink cartridge 1 in the carriage 200 as described earlier. By so doing, the air vent hole 100 will communicate with the outside, allowing air to be introduced into interior of the ink cartridge 1. The sealing film 54 is designed to be ruptured by an ink delivery needle 240 provided on the carriage 200 when the ink cartridge 1 is installed in the carriage 200 of the ink-jet printer.

In the interior of the liquid delivery port 50 are housed, in order from the lower face side, a seal member 51, a spring seat 52, and a blocking spring 53. When the ink delivery needle 240 has been inserted into the liquid delivery port 50, the seal member 51 will function to seal the gap between the inside wall of the liquid delivery port 50 and the outside wall of the ink delivery needle 240. The spring seat 52 is adapted to contact the inside wall of the seal member 51 and block off the liquid delivery port 50 when the ink cartridge 1 is not installed in the carriage 200. The blocking spring 53 is adapted to urge the spring seat 52 in the direction of contact with the inside wall of the seal member 51. When the ink delivery needle 240 is inserted into the liquid delivery port 50, the upper end of the ink delivery needle 240 will push up the spring seat 52 and create a gap between the spring seat 52 and the seal member 51 so that ink is delivered to the ink delivery needle 240 through this gap.

Figure 8:
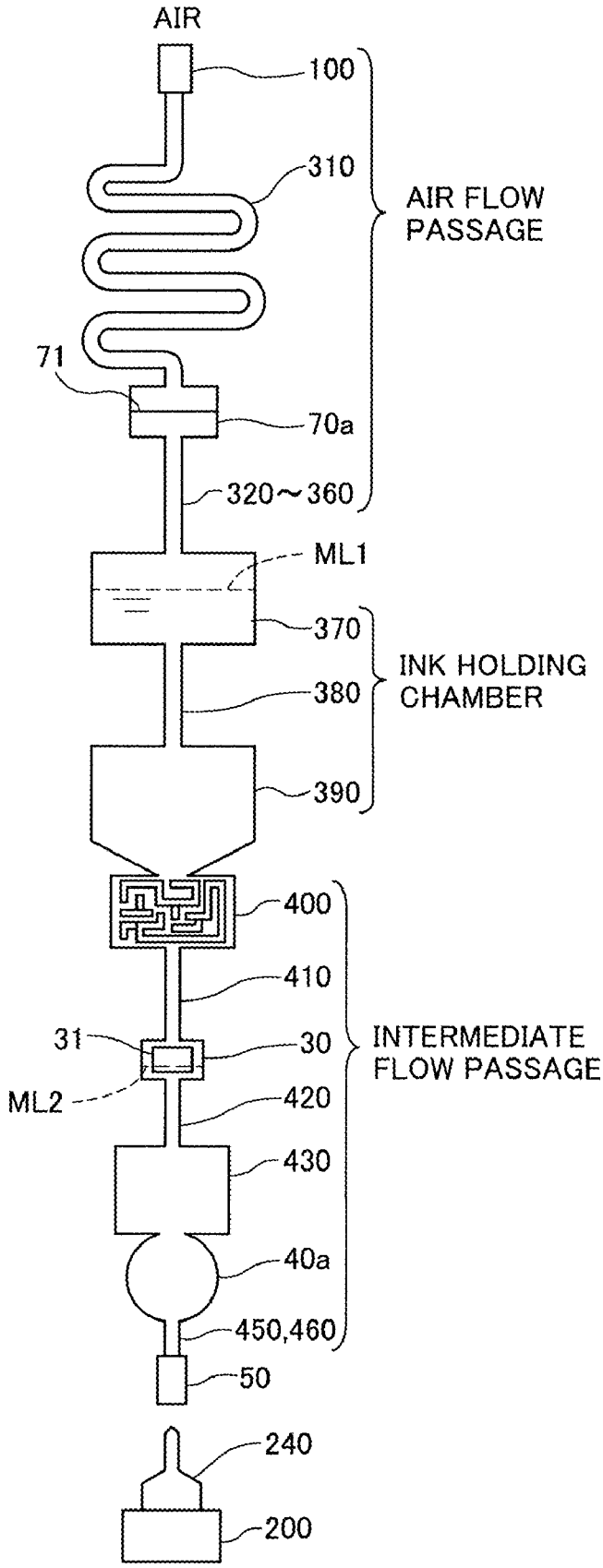
FIG. 8 is a diagram depicting conceptually the pathway leading from an air vent hole to a liquid delivery port.

Next, before proceeding to a more detailed description of the internal structure of the ink cartridge 1, for purposes of aiding understanding, the pathway leading from the air vent hole 100 to the liquid delivery port 50 will be described in conceptual terms with reference to FIG. 8. FIG. 8 is a diagram depicting conceptually the pathway leading from the air vent hole to the liquid delivery port.

The pathway leading from the air vent hole 100 to the liquid delivery port 50 will be broadly divided into ink storage chambers for holding ink, an air flow passage situated on the upstream side of the ink storage chambers, and an intermediate flow passage situated on the downstream side of the ink storage chambers.

The ink storage chambers include, in order from the upstream side, a first ink holding chamber 370, a holding chamber connector passage 380, and a second ink holding chamber 390. The upstream end of the holding chamber connector passage 380 communicates with the first ink holding chamber 370, while the downstream end of the holding chamber connector passage 380 communicates with the second ink holding chamber 390.

The air flow passage includes, in order from the upstream side, a serpentine passage 310, a vapor-liquid separation chamber 70*a* that houses the vapor-liquid separation membrane 71 discussed earlier, and connecting paths 320 to 360 that connect the vapor-liquid separation chamber 70*a* with the ink storage chamber. The serpentine passage 310 communicates at its upstream end with the air vent hole 100, and at its downstream end with the vapor-liquid separation chamber 70*a*. The serpentine passage 310 is elongated and extends in a sinuous configuration so as to maximize the distance from the air vent hole 100 to the first ink holding chamber 370. Through this arrangement, evaporation of moisture from the ink inside the ink storage chambers will be kept to a minimum. The vapor-liquid separation membrane 71 is constructed of material that permits vapor to pass, but does not allow liquid to pass. By situating the vapor-liquid separation membrane 71 between the upstream end and the downstream end of the vapor-liquid separation chamber 70*a*, ink backflowing from the ink storage chambers will be prevented from advancing upstream beyond the vapor-liquid separation chamber 70*a*. The specific configuration of the connecting paths 320 to 360 will be discussed later.

The intermediate flow passage includes, in order from the upstream side, a labyrinthine flow passage 400, a first flow passage 410, the aforementioned sensor section 30, a second flow passage 420, a buffer chamber 430, the aforementioned differential pressure valve housing chamber 40*a* housing the differential pressure valve 40, and third flow passages 450, 460. The labyrinthine flow passage 400 has a three-dimensional labyrinthine configuration and includes the space defined by the aforementioned labyrinthine passage forming chamber 95*a*. Through the labyrinthine flow passage 400, air bubbles entrained in the ink will be trapped so as to prevent air bubbles from being entrained in the ink downstream from the labyrinthine flow passage 400. The labyrinthine flow passage 400 is also termed an "air bubble trap flow passage." The first flow passage 410 communicates at its upstream end with the labyrinthine flow passage 400, and communicates at its downstream end with the sensor flow passage forming chamber 30*b* of the sensor section 30. The second flow passage 420 communicates at its upstream end with the sensor flow passage forming chamber 30*b* of the sensor section 30, and at its downstream end with the buffer chamber 430. The buffer chamber 430 communicates directly with the differential pressure valve housing chamber 40*a* with no intervening flow passage. By doing this, it is possible to decrease the space from the buffer chamber 430 to the liquid delivery port 50, and to reduce pressure loss. In the differential pressure valve housing chamber 40*a*, through the action of the differential pressure valve 40, the pressure of the ink to the downstream side of the differential pressure valve housing chamber 40*a* will be maintained to be lower than the ink pressure on the upstream side, so that the ink in the downstream side assumes negative pressure. The third flow passages 450, 460 (see FIG. 9) communicate at the upstream side with the differential pressure valve housing chamber 40*a* and at the downstream side with the liquid delivery port 50. These third flow passages 450, 460 define vertical flow passages through which ink exiting the differential pressure valve housing chamber 40*a* will be guided vertically downward and into the liquid delivery port 50.

At the time of manufacture of the ink cartridge 1, the cartridge will be filled up to the first ink holding chamber 370, as indicated by the liquid level depicted conceptually by the broken line ML1 in FIG. 8. In the absence of an additional large-capacity ink tank 900 (FIGS. 1A, 1B, 2A, 2B), as the ink inside the ink cartridge 1 is consumed by the ink-jet printer the liquid level will move towards the downstream end and it will be replaced by air flowing into the ink cartridge 1 from the upstream end through the air vent hole 100. As ink consumption progresses, the liquid level will reach the sensor section 30 indicated by the liquid level depicted conceptually by the broken line ML2 in FIG. 8. At this point, air will enter the sensor section 30, and ink depletion will be detected by the liquid level sensor 31. Once ink depletion has been detected, the ink jet printer will halt printing and alert the user at a stage before the ink present to the downstream side of the sensor section 30 (in the buffer chamber 430 etc.) is completely consumed. This is because if the ink is totally depleted, when it is attempted to continue further printing there is a risk that air may be drawn into the print head and cause problems.

Figure 9:
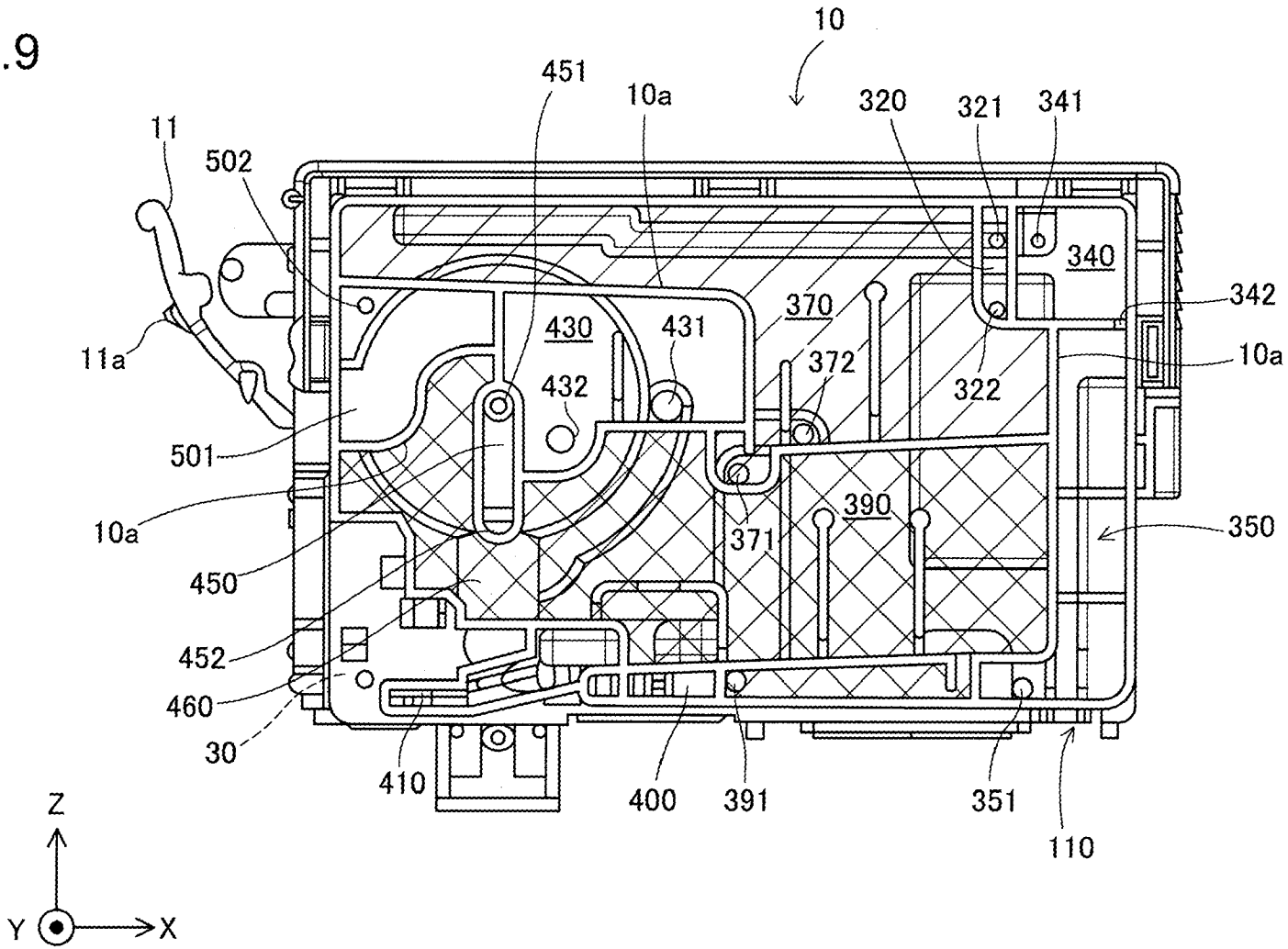
FIG. 9 is a drawing depicting a cartridge body from the front face side.
Figure 10:
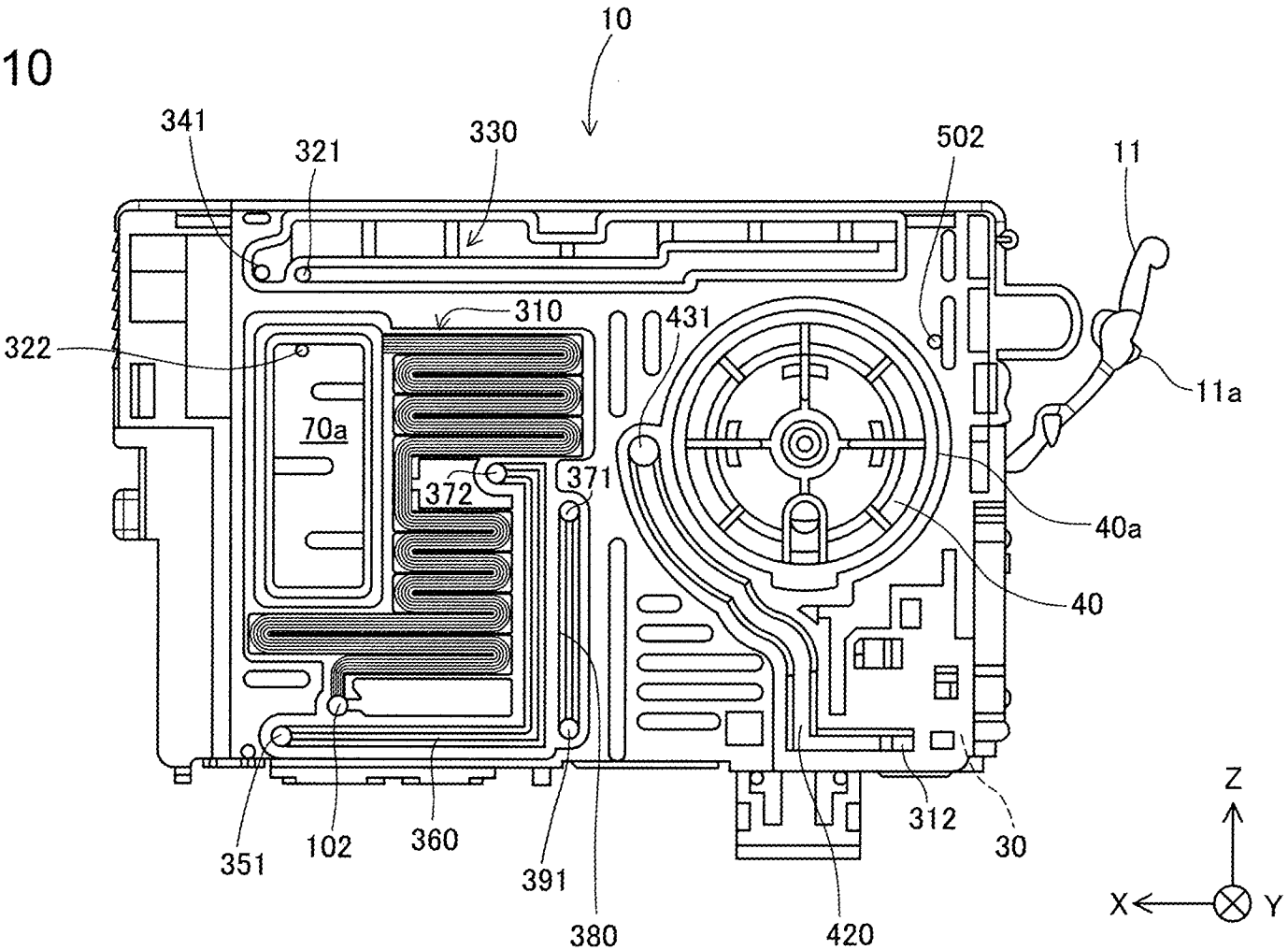
FIG. 10 is a drawing depicting a cartridge body from the back face side.
Figure 11A:
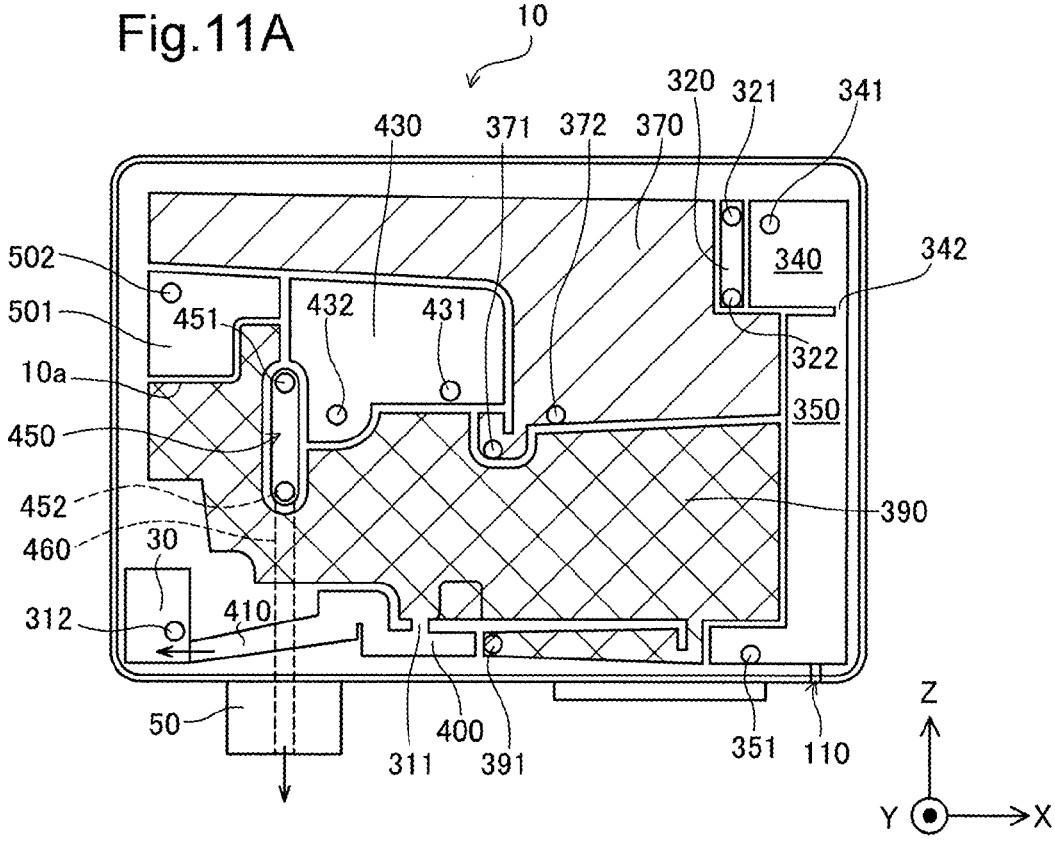
FIGS. 11A and 11B are diagrams of FIG. 9 and FIG. 10 in simplified form.
Figure 11B:
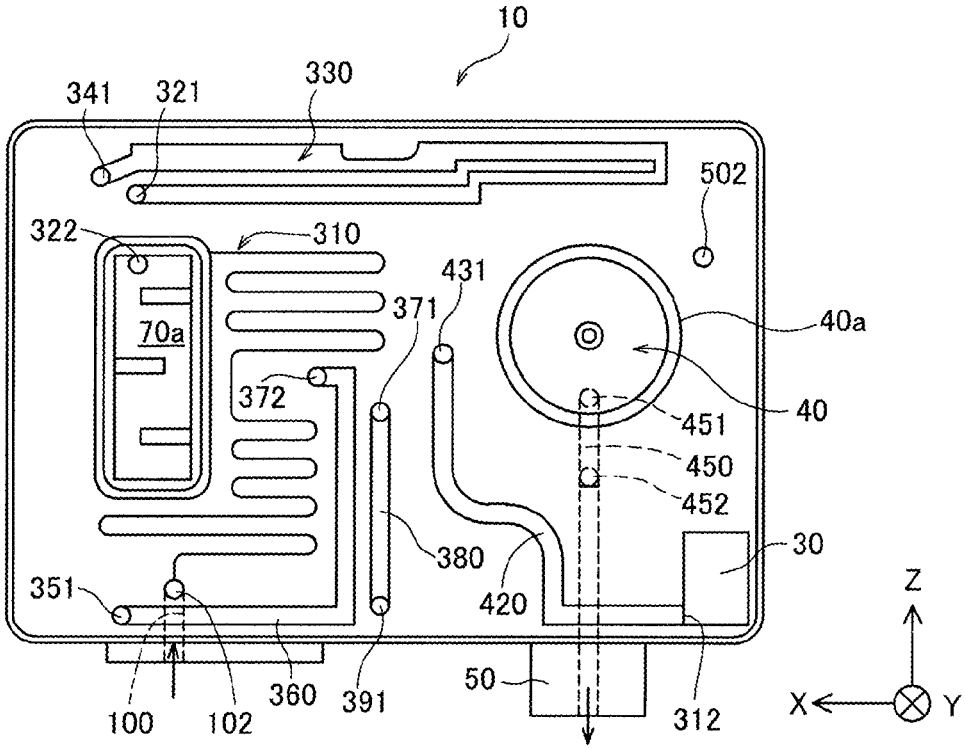

The specific configuration of each element on the pathway from the air vent hole 100 to the liquid delivery port 50 within the ink cartridge 1 will be described with reference to FIGS. 9 to 11B. FIG. 9 is a drawing depicting the cartridge body 10 from the front face side. FIG. 10 is a drawing depicting the cartridge body 10 from the back face side. FIG. 11A is a model diagram of FIG. 9 in simplified form. FIG. 11B is a model diagram of FIG. 10 in simplified form.

In the ink storage chambers, the first ink holding chamber 370 and the second ink holding chamber 390 are formed on the front face side of the cartridge body 10. In FIG. 9 and FIG. 11A, the first ink holding chamber 370 and the second ink holding chamber 390 are shown respectively by single hatching and crosshatching. The holding chamber connector passage 380 is formed on the back face side of the cartridge body 10, at the location shown in FIG. 10 and FIG. 11B. A communication hole 371 is provided to connect the upstream end of the holding chamber connector passage 380 with the first ink holding chamber 370, and a communication hole 391 is provided to connect the downstream end of the holding chamber connector passage 380 with the second ink holding chamber 390.

In the air flow passage, the serpentine passage 310 and the vapor-liquid separation chamber 70*a* are formed on the back face side of the cartridge body 10, at the respective locations shown in FIG. 10 and FIG. 11B. A communication hole 102 is provided to connect the upstream end of the serpentine passage 310 with the air vent hole 100. The downstream end of the serpentine passage 310 passes through the side wall of the vapor-liquid separation chamber 70*a* and communicates with the vapor-liquid separation chamber 70*a*.

Turning now to a more detailed description of the connecting paths 320 to 360 of the air flow passage depicted in FIG. 8, these are composed of a first space 320, a third space 340, and a fourth space 350 situated on the front face side of the cartridge body 10 (see FIG. 9 and FIG. 11A), and a second space 330 and a fifth space 360 situated on the back face side of the cartridge body 10 (see FIG. 10 and FIG. 11B), these spaces being situated in-line, in order of their assigned symbols from the upstream end, to define a single flow passage. A communication hole 322 is provided to connect the vapor-liquid separation chamber 70*a* to the first space 320. Communication holes 321, 341 are provided to connect the first space 320 with the second space 330, and the second space 330 with the third space 340, respectively. The third space 340 and the fourth space 350 communicate with one another through a notch 342 that has been formed in the rib separating the third space 340 and the fourth space 350. Communication holes 351, 372 are provided to connect the fourth space 350 with the fifth space 360, and the fifth space 360 with the first ink holding chamber 370, respectively.

In the intermediate flow passage, the labyrinthine flow passage 400 and the first flow passage 410 are formed on the front face side of the cartridge body 10 at the respective locations shown in FIG. 9 and FIG. 11A. A communication hole 311 is provided in the rib that separates the second ink holding chamber 390 from the labyrinthine flow passage 400, and connects the second ink holding chamber 390 with the labyrinthine flow passage 400. As discussed previously with reference to FIG. 6, the sensor section 30 is situated on the lower face side of the right face of the cartridge body 10 (FIGS. 9 to 11B). The second flow passage 420 and the aforementioned vapor-liquid separation chamber 70*a* are formed on the back face side of the cartridge body 10 at the respective locations shown in FIG. 10 and FIG. 11B. The buffer chamber 430 and the third flow passage 450 are formed on the front face side of the cartridge body 10 at the respective locations shown in FIG. 9 and FIG. 11A. A communication hole 312 is provided to connect the labyrinthine passage forming chamber 95*a* (FIG. 6) of the sensor section 30 with the second flow passage 420; and a communication hole 431 is provided to connect the downstream end of the second flow passage 420 with the buffer chamber 430. A communication hole 432 is provided to directly connect the buffer chamber 430 with the differential pressure valve housing chamber 40*a*. Communication holes 451,452 are provided to respectively connect the differential pressure valve housing chamber 40*a* with the third flow passage 450, and the third flow passage 450 with the ink delivery hole inside the liquid delivery port 50. As mentioned earlier, in the intermediate flow passage, the labyrinthine flow passage 400 and the sensor section 30 (the labyrinthine passage forming chamber 95*a* and the sensor flow passage forming chamber 30*b* of FIG. 5) are the sections of the flow passage in which flow resistance is highest.

A space 501 shown in FIG. 9 and FIG. 11A is an unfilled space that is not filled with ink. The unfilled space 501 is not situated on the pathway leading from the air vent hole 100 to the liquid delivery port 50, but is rather independent. An outside air communication hole 502 that communicates with the outside air is formed on the back face side of the unfilled space 501. The unfilled space 501 serves as a degassing space that is brought to negative pressure when the ink cartridge 1 is packaged in a vacuum pack. Thus, as long as the ink cartridge 1 is kept in the package, the inside pressure of the cartridge body 10 will be maintained below a prescribed pressure value so that the cartridge can deliver ink with negligible dissolved air.

The discussion now turns to a method of manufacturing an ink delivery system (FIG. 1B, FIG. 2B) that employs the ink cartridge described above.

C. Configuration of Ink Cartridge for Use in Ink Delivery System and Manufacturing Method Thereof

C1. First Embodiment

Figure 12:
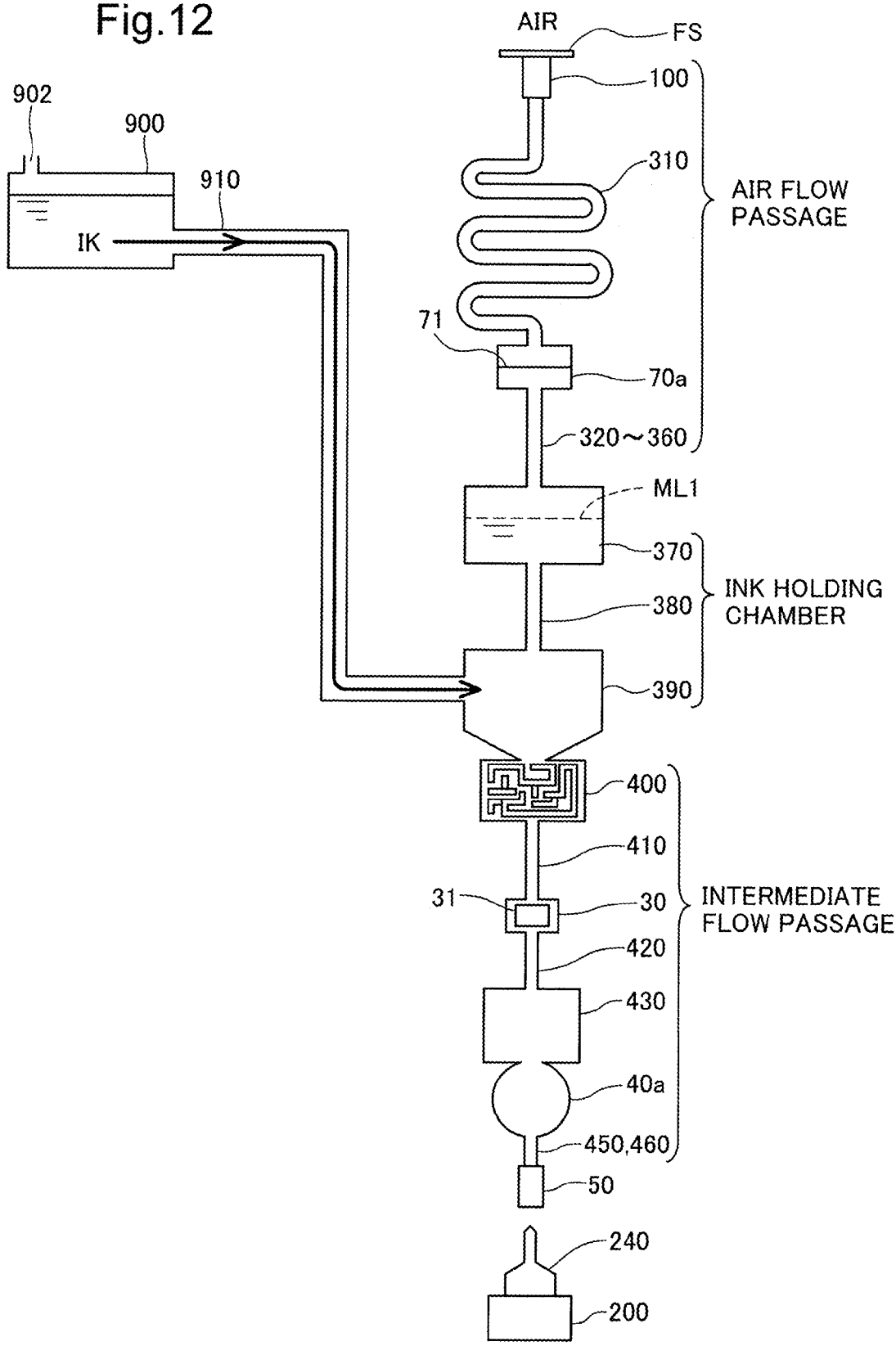
FIG. 12 is a drawing conceptually showing the path of the ink delivery system of the first embodiment.

FIG. 12 is a drawing that conceptually shows the path of the ink delivery system with the first embodiment. The large capacity ink tank 900 is connected to the second ink holding chamber 390 via the tube 910. The large capacity ink tank 900 has an air communication hole 902 vented to the atmosphere. Then, the air vent hole 100 is sealed by the seal member FS. As a result, even when ink is consumed, the liquid surface ML1 of the ink cartridge 1 interior does not fluctuate. This is because the air from the air vent hole 100 is not introduced. In contrast to this, when ink is consumed, the air from the air communication hole 902 is introduced to the large capacity ink tank 900, and ink IK is delivered from the large capacity ink tank 900 to the second ink holding chamber 390. Therefore, it is possible to supply ink from the large capacity ink tank 900 to the second ink holding chamber 390 at a suitable pressure.

Figure 13:
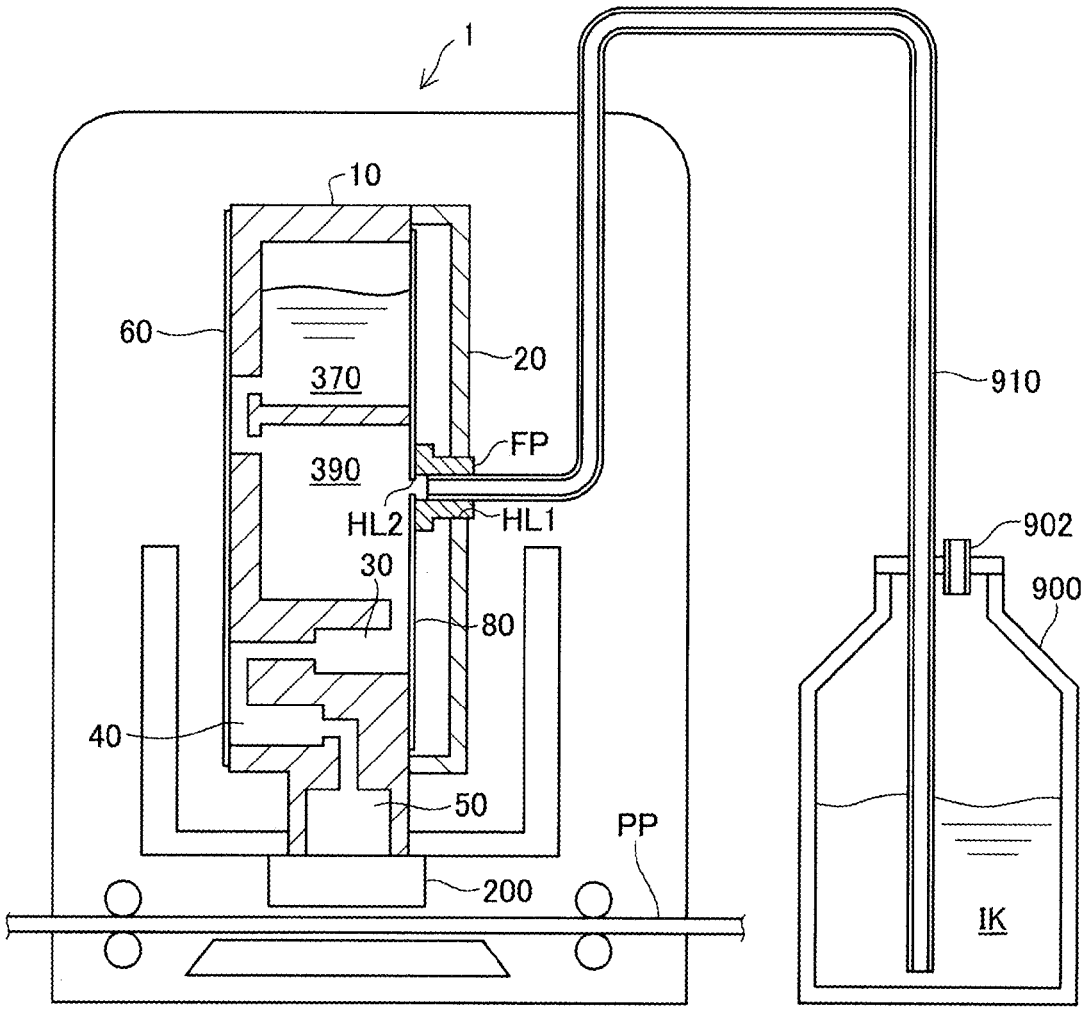
FIG. 13 is an explanatory drawing showing the method of connecting the ink cartridge and the ink supply tube with the first embodiment.

FIG. 13 is an explanatory drawing showing the method of connecting the ink cartridge and the ink supply tube 910 with the first embodiment. The end part of the ink cartridge 1 side of the ink supply tube 910 pierces through the through hole HL1 provided on the cover member 20, and is connected so as to link with the through hole HL2 provided on the film 80. Here, the through hole HL2 is provided on the port that forms the second ink holding chamber 390. So as not to have liquid leakage or mixing in of air occur, a seal member FP is used to form a liquid-tight and air-tight seal between the through hole HL2 and the ink cartridge 1 side end part of the ink supply tube 910, and the outside. Note that the tube 910 is preferably formed using a flexible material. Also, the seal member FP is preferably formed using an elastic body such as rubber, an elastomer or the like. Also, the seal member FP is engaged in the through hole HL1 provided on the cover member 20, and supports the ink supply tube 910.

The work of connecting the tube 910 is executed using the following procedure, for example. First, the ink cartridge, the tube 910, and the seal member FP are prepared. This ink cartridge can be the item described using FIG. 3 to FIG. 11. With the ink cartridge before connecting the tube 910, as shown in FIGS. 5 and 6, the wall surface on the front surface side of the second ink holding chamber 390 is formed by the film 80, and is in a state for which the cover member 20 is fit onto the outside. In light of this, first, the cover member 20 is removed, and the through hole HL1 is formed by cutting processing or the like on the part facing opposite the second ink holding chamber 390. After that, the seal member FP is fit in the through hole HL1 from the inside of the cover member 20. Then, an adhesive is applied to the part of the seal member FP in contact with the film 80, and the cover member 20 is again fit in the cartridge main unit 10. At this time, the end part of the seal member FP is adhered to the part of the film 80 that forms the second ink storage chamber 390. After adhering the seal member FP to the film 80, a needle member or the like is pierced from outside into the cylindrical cavity part inside the seal member FP, and the through hole HL2 is formed on the film 80. After the through hole HL2 is formed, the end part of the ink cartridge 1 side of the ink supply tube 910 is inserted into the cylindrical cavity part inside the seal member FP to connect. By doing this series of tasks, the work of connecting the tube 910 to the ink cartridge 1 is completed. Also, by connecting the tube 910 to the large capacity ink tank 900, the ink delivery system is completed.

With this embodiment, it is possible to connect the ink supply tube 910 to the ink cartridge 1 without implementing a hole opening process in the cartridge body 10, so it is possible to easily produce the ink delivery system.

Also, with this embodiment, the ink supply tube 910 is connected to the second ink holding chamber 390 of the upstream side from the differential pressure valve 40. Therefore, it is possible to deliver ink supplied via the tube 910 to the printing head in a stable pressure state using the function of the differential pressure valve 40. With this embodiment, the ink supply tube 910 is connected to the second ink holding chamber 390 of the upstream side from the sensor section 30. Therefore, when the ink of the large capacity ink tank 900 has been depleted, it is possible to suitably detect ink depletion at the sensor unit 30.

Also, with this embodiment, using the seal member FP, it is possible to suppress the occurrence of ink leakage or mixing in of air from the connection part of the through hole HL2 and the ink supply tube 910. Also, the seal member FP is affixed to the cover member 20, so it is possible to suppress problems such as bending of the ink supply tube 910.

C2. First Embodiment Modified Example

Figure 14:
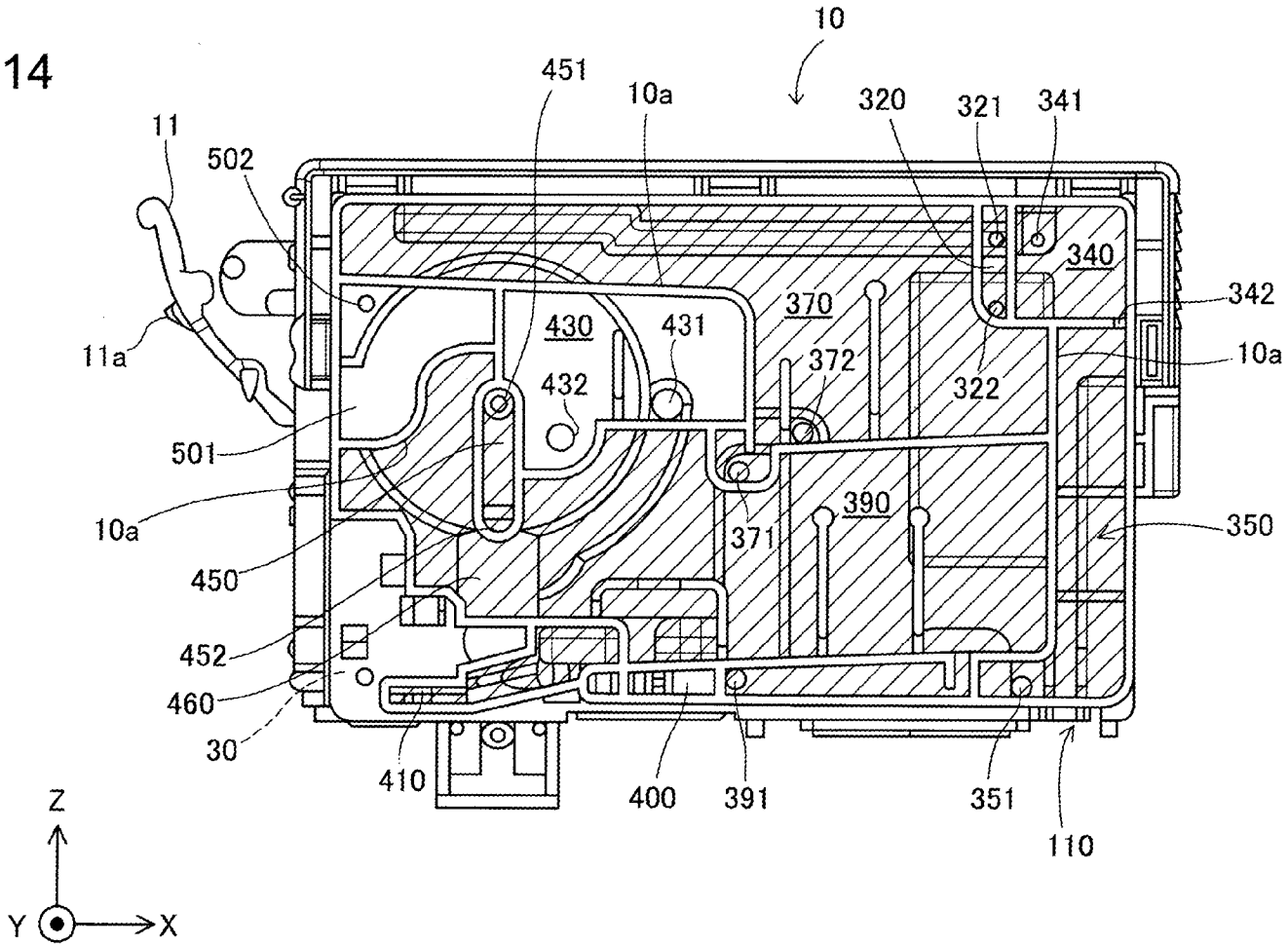
FIG. 14 is a drawing for describing the location at which the ink supply tube can be connected with the film.

FIG. 14 is a drawing for describing the location at which it is possible to connect the ink supply tube 910 with the film 80. The first embodiment noted above has formed the through hole HL2 that connects the ink supply tube 910 to the second ink holding chamber 390, but the through hole HL2 can be formed on any part shown by hatching in FIG. 14. The through hole HL2 can also be formed on the first ink holding chamber 370 as shown in FIG. 14, for example, or can be formed on the third space 340. Also, the through hole HL2 can be formed on the fourth space 350, can be formed on the first flow passage 410, can be formed on the first space 320, or can be formed on the third flow passage 450.

C3. Second Embodiment

Figure 15:
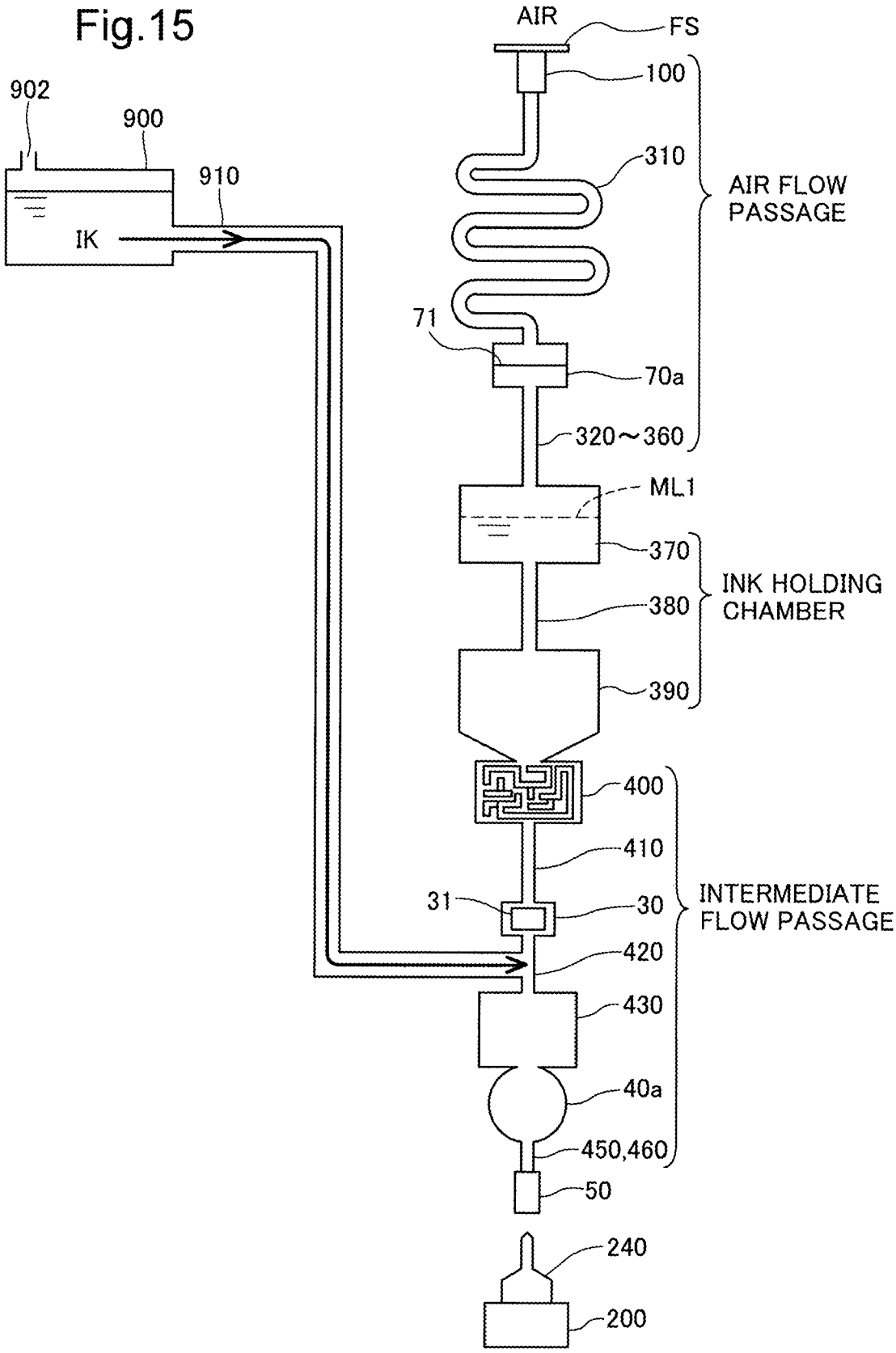
FIG. 15 is a drawing conceptually showing the path of the ink delivery system with the second embodiment.

FIG. 15 is a drawing conceptually showing the path of the ink delivery system with the second embodiment. The large capacity ink tank 900 is connected to the second flow passage 420 via the tube 910. The remainder of the constitution is the same as the first embodiment described while referring to FIG. 12, so that description will be omitted. With the second embodiment as well, it is possible to supply ink into the second ink holding chamber 390 from the large capacity ink tank 900 at a suitable pressure.

Figure 16:
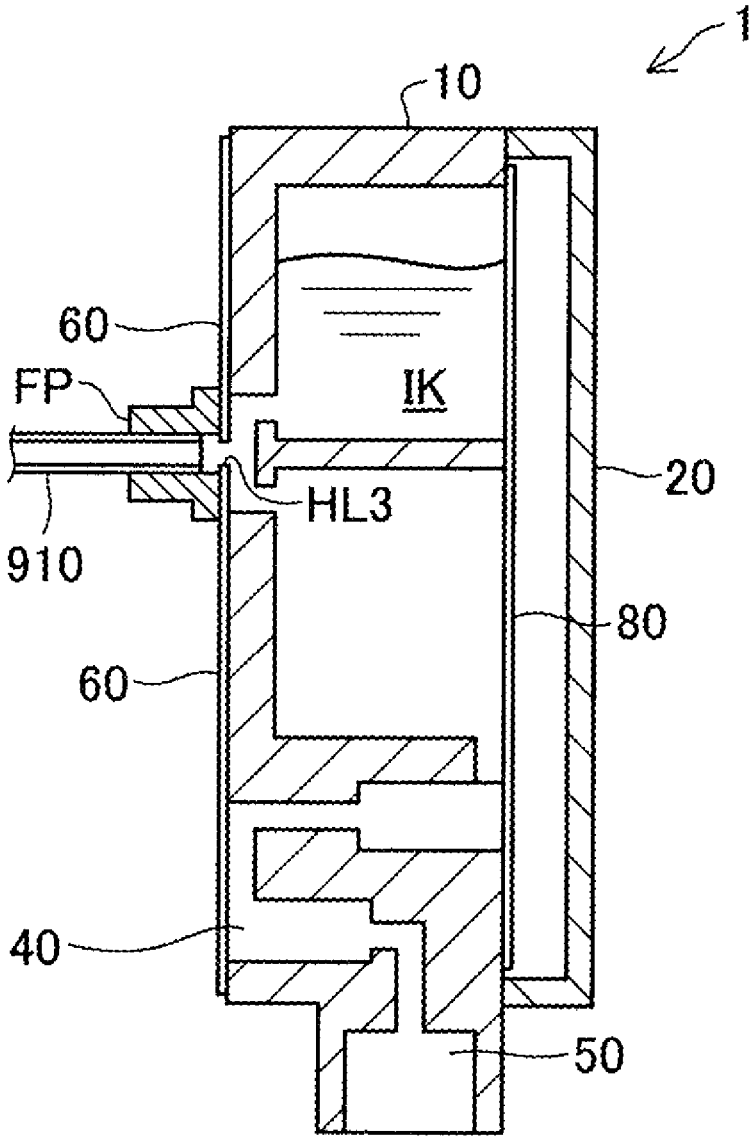
FIG. 16 is an explanatory drawing showing the method of connecting the ink cartridge and the ink supply tube with the second embodiment.

FIG. 16 is an explanatory drawing showing the method of connecting the ink cartridge and the ink supply tube 910 with the second embodiment. The end part of the ink cartridge 1 side of the ink supply tube 910 is connected so as to link to the through hole HL3 provided on the outer surface film 60. Here, the through hole HL3 is provided on the part that forms the second flow passage 420. So that liquid leakage or mixing in of air does not occur, there is a liquid tight and airtight seal using the seal member FP between the through hole HL3 and the end part of the ink cartridge 1 side of the ink supply tube 910, and the outside. The tube 910 and the seal member FP constitutions are the same as with the first embodiment.

The work of connecting the tube 910 is executed using the following procedure, for example. First, the ink cartridge, the tube 910, and the seal member FP are prepared. This ink cartridge can be the item described using FIG. 3 to FIG. 11. With the ink cartridge 1, as shown in FIGS. 5 and 6, the wall surface of the back surface side of the second flow passage 420 is formed by the outer surface film 60. An adhesive agent is attached to the part of the seal member FP that contacts the outer surface film 60, and the end part of the seal member FP is adhered to the part that forms the second flow passage 420. After adhering the seal member FP to the sealing film 90, the needle member or the like is pierced through into the cylindrical cavity part on the interior of the seal member FP from the outside, and forms the through hole HL3 on the outer surface film 60. After the through hole HL3 is formed, the end part of the ink cartridge 1 side of the ink supply tube 910 is inserted into the cylindrical cavity part on the interior of the seal member FP to connect. By this series of operations, the work of connecting the tube 910 to the ink cartridge 1 is completed. By connecting the tube 910 to the large capacity ink tank 900, the ink delivery system is completed.

With this embodiment as well, it is possible to connect the ink supply tube 910 to the ink cartridge 1 without implementing hole opening processing on the cover member 20 and the cartridge body 10, so it is possible to easily create an ink delivery system.

Also, with this embodiment as well, the ink supply tube 910 is connected to the second ink holding chamber 390 of the upstream side from the differential pressure valve 40. Therefore, the ink supplied via the tube 910 can be delivered to the printing head in a stable pressure state using the function of the differential pressure valve 40.

Also, with this embodiment, it is possible to suppress the occurrence of ink leakage and mixing in of air from the connection part of the through hole HL3 and the ink supply tube 910 by using the seal member FP.

C4. Second Embodiment Modified Example

Figure 17:
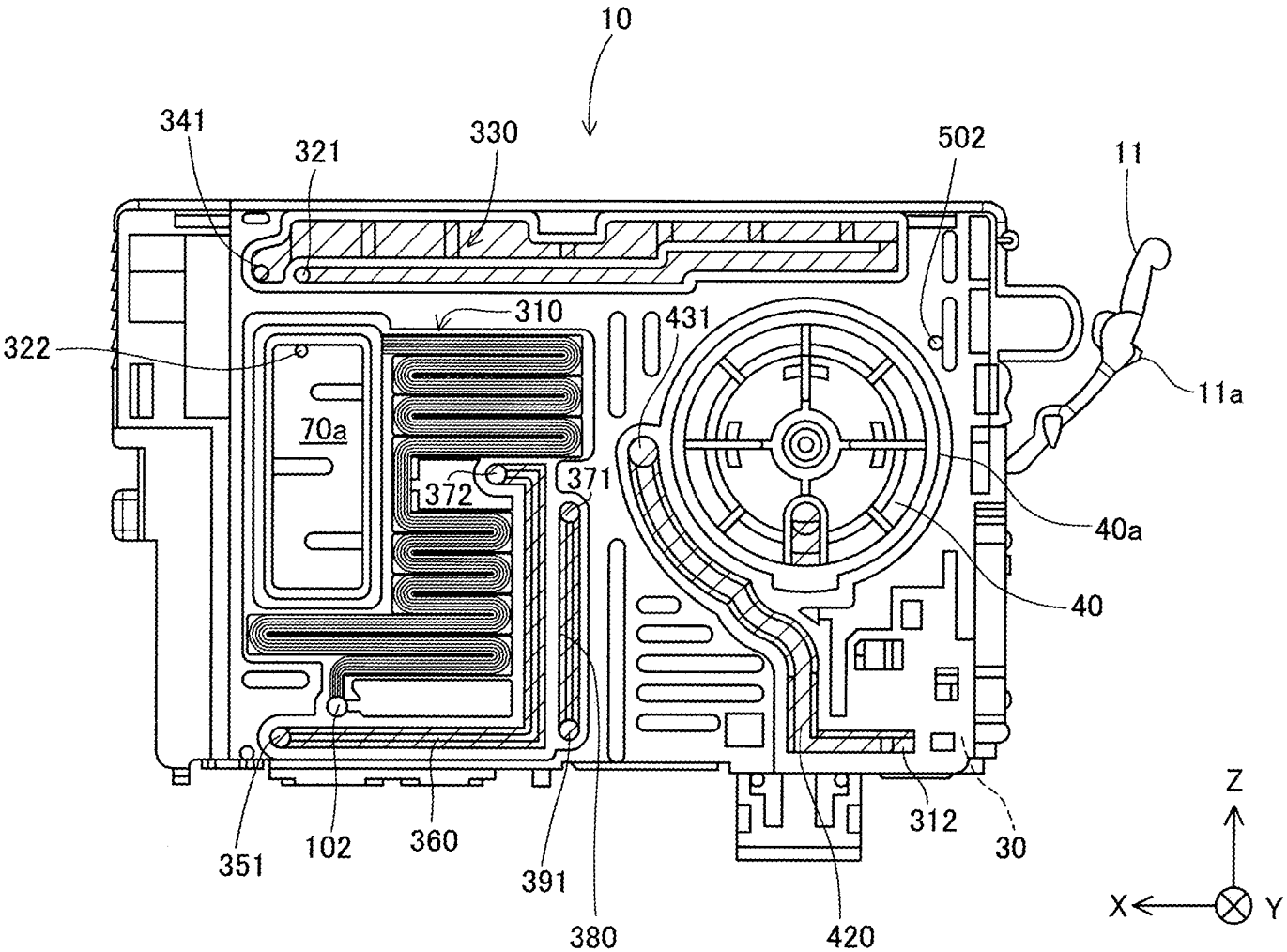
FIG. 17 is a drawing for describing the location at which the ink supply tube can be connected with the outer surface film.

FIG. 17 is a drawing for describing the locations at which it is possible to connect the ink supply tube 910 with the outer surface film 60. With the second embodiment noted above, the through hole HL3 that connects the ink supply tube 910 to the second flow passage 420 is formed, but the through hole HL3 can also be formed at either part shown by hatching in FIG. 17. For example, as shown in FIG. 17, the through hole HL3 can be formed on the second space 330, or can be formed on the holding chamber connection path 380. Also, the through hole HL3 can be formed on the fifth space 360.

D. Other Modified Examples

D1. Modified Example 1

Figure 18:
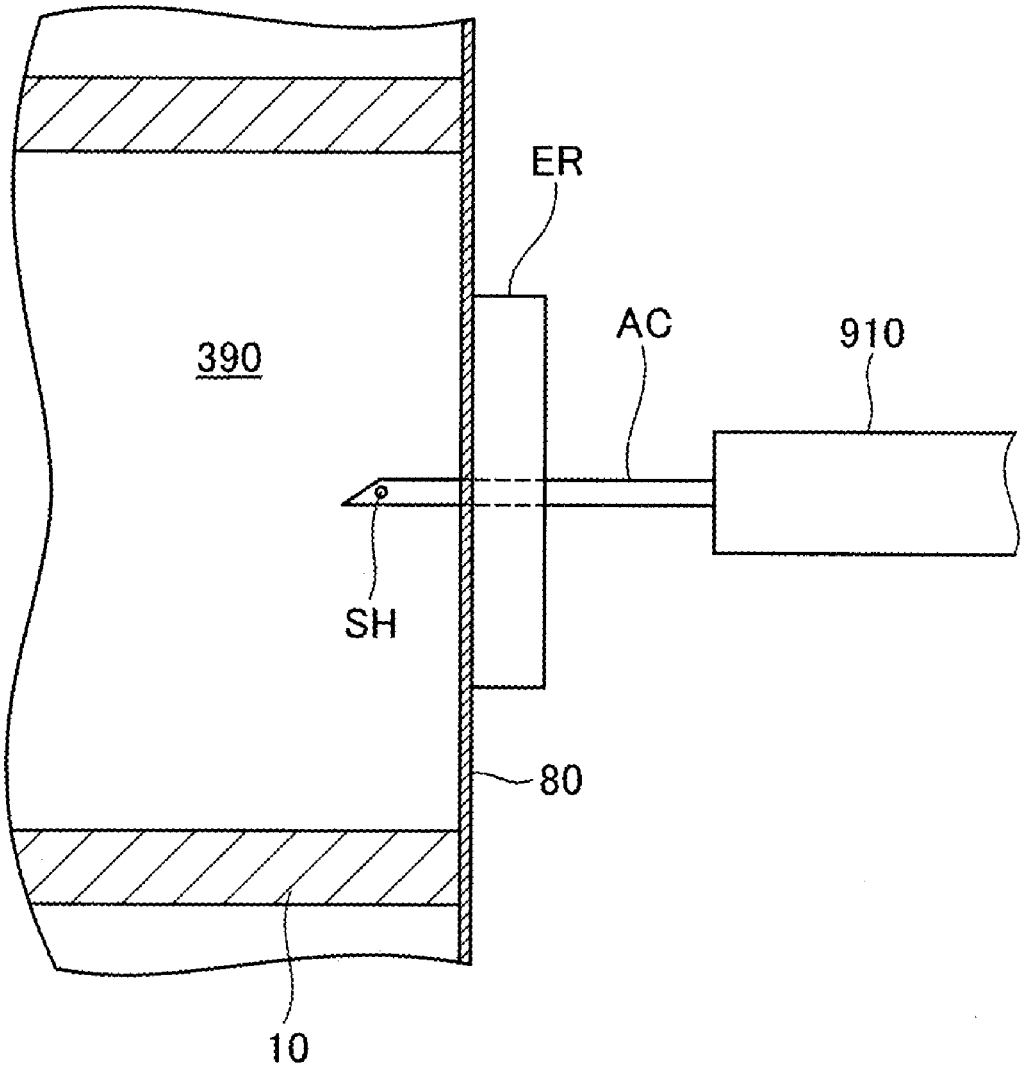
FIG. 18 is an explanatory drawing showing the method of connecting the ink cartridge and the ink supply tube with the second embodiment.

FIG. 18 is an explanatory drawing showing the method of connecting the ink cartridge and the ink supply tube 910 with the first modified example. With the first and second embodiments noted above, the ink supply tube 910 is connected to the ink cartridge 1 via the seal member FP, but instead of this, it is also possible to use various other methods. For example, as shown in FIG. 18, it is also possible to connect the ink supply tube 910 to the second ink holding chamber 390 via the hollow needle member AC. With this example, with the hollow needle member AC, the interior is hollow, and it is possible for the ink to flow. One end of the hollow space of the inside of the hollow needle member AC is connected to the end part of the ink cartridge 1 side of the ink supply tube 910 for which it is possible for ink to be introduced, and the other end is linked to outside via the tip hole SH. With this modified example, first, the ink cartridge 1 and the ink supply tube 910 to which the hollow needle member AC is connected at the tip are prepared. Then, the elastic sheet ER is adhered using an adhesive agent to the part that forms the second ink holding chamber 390 of the film 80. After that, from the front surface side of the film 80, the hollow needle member AC is inserted to pass through the elastic sheet ER and the part of the film 80 stuck to the elastic sheet ER. At this time, the tip hole SH formed at the tip part of the hollow needle member AC is made to be positioned inside the second ink holding chamber 390. By doing this, it is possible to very easily connect the ink supply tube 910 to the ink cartridge 1. This kind of method can be used not only in cases of connecting the ink supply tube 910 to the film 80 side but also in cases of connecting the ink supply tube 910 to the outer surface film 60 side.

D2. Modified Example 2

While the preceding embodiments describe various flow passages, holding chambers, and communication holes provided to the ink cartridges, some of these arrangements may be dispensed with.

D3. Modified Example 3

While in the preceding embodiments, a large-capacity ink tank 900 is employed as the ink supply device, an ink supply device of some other configuration may be used. For example, it is possible to employ an ink supply device having a pump provided between the large-capacity ink tank 900 and the ink cartridge 1.

D4. Modified Example 4

While the preceding embodiments have described an ink delivery system adapted for an ink-jet printer, the present invention is adaptable generally to liquid delivery systems that deliver a liquid to a liquid jetting device or a liquid consuming device; with appropriate modifications, it is possible for the invention to be employed in liquid consuming devices of various kinds equipped with a liquid jetting head adapted to eject small amounts of a liquid in drop form. Herein, a drop refers to the state of the liquid ejected from the liquid jetting device, and includes those with tails of granular, teardrop, or filiform shape. Herein, a liquid refers to any material that can be jetted from a liquid jetting device. For example, substances of any state when in the liquid phase would be acceptable including those of a high- or low-viscosity liquid state, of a fluid state such as a sol, gel water, or other inorganic solvent, organic solvent, solution, liquid resin, liquid metal (molten metal), or substances having the liquid state as one of their states; as well as materials containing particles of functional materials consisting of solids such as pigments or metal particles dissolved, dispersed, or mixed into a medium. Typical examples of liquids are the inks described in the preceding embodiments, and liquid crystals. Here, the term "ink" is used to include typical water based inks and oil based inks, as well as shellac, hot melt inks, and various other kinds of liquid compositions. Specific examples of liquid consuming devices are liquid jetting devices adapted to jet liquids containing materials such as electrode materials or coloring matter in dispersed or dissolved form, and employed in manufacturing liquid crystal displays, EL (electroluminescence) displays, plane emission displays, or color filters; liquid jetting devices adapted to jet liquids containing bioorganic substances used in biochip manufacture; liquid jetting devices adapted to jet liquids as specimens for use as precision pipettes; textile printing devices; or microdispensers. The system may further be employed as a delivery system in liquid jetting devices used for pinpoint application of lubricants to precision instruments such as clocks or cameras; in liquid jetting devices adapted to jet an ultraviolet curing resin or other transparent resin solution onto a substrate for the purpose of forming a micro semi-spherical lens (optical lens) for use in optical communication elements etc.; or in liquid jetting devices adapted to jet an acid or alkali etchant solution for etching circuit boards etc. The present invention is adaptable as a delivery system to any of the above types of liquid jetting devices. The liquid delivery systems that deliver liquid other than ink will employ a liquid flow passage member made of material suitable for the particular liquid, in place of the ink supply tube.

What is claimed is:

1. A liquid delivery system for delivering liquid to a liquid jetting device, comprising:

a liquid container that is installable on the liquid jetting device and which includes a cover member;

a liquid supply device that supplies the liquid to the liquid container as a result of the consumption of the liquid from the liquid container by the liquid jetting device; and a liquid flow passage member that connects the liquid supply device with the liquid container and which extends through a hole provided through the cover member of the liquid container, wherein the liquid container has:

a container main unit that includes a recess portion having an opening on a first surface of the liquid container, and a liquid delivery portion that supplies the liquid to the liquid jetting device; and a sealing film that seals the opening of the recess portion to define together with an inner surface of the recess portion, a chamber and an inner flow passage at an upstream side of the liquid delivery portion, the cover member covering the sealing film, wherein the liquid flow passage member is connected to at least one of the chamber and the inner flow passage via a hole provided on the sealing film.

2. The liquid delivery system according to claim 1, wherein the liquid flow passage member is affixed to the cover member.

3. The liquid delivery system according to claim 1, wherein the liquid container further comprises a sensor for detecting presence or absence of the liquid at a first position of the inner flow passage, and the liquid flow passage member is connected to the at least one of the chamber and the inner flow passage at an upstream side from the first position.

4. The liquid delivery system according to claim 1, wherein the liquid container further comprises a valve member arranged at a second position of the inner flow passage, for adjusting the pressure difference of an upstream side and downstream side of the second position, and the liquid flow passage member is connected to the at least one of the chamber and the inner flow passage at an upstream side from the second position.

5. The liquid delivery system according to claim 1, further comprising a seal member that makes a liquid-tight seal between the sealing film and the liquid flow passage member.

6. A method of manufacturing a liquid delivery system for delivering liquid to a liquid jetting device, comprising the steps of:

(a) preparing a liquid container that is installable on the liquid jetting device, the liquid container comprising a cover member, (b) preparing a liquid supply device that supplies the liquid to the liquid container as a result of the consumption of the liquid from the liquid container by the liquid jetting device, and (c) connecting a liquid flow passage member between the liquid container and the liquid supply device through a hole through the cover member, the liquid container comprising:

a container main unit that includes a recess having an opening on a first surface of the liquid container, and a liquid delivery unit that supplies the liquid to the liquid jetting device, and a sealing film that seals the opening of the recess portion to define together with an inner surface of the recess portion a chamber and a inner flow passage at an upstream side of the liquid delivery portion, the cover member covering the sealing film, and the step (c) including the steps of:

(i) providing a hole on the sealing film, and (ii) connecting the liquid flow passage member to at least one of the chamber and the inner flow passage via the hole.

* * * * *

UNITED STATES PATENT AND TRADEMARK OFFICE

CERTIFICATE OF CORRECTION

PATENT NO. : 8,182,075 B2
APPLICATION NO. : 12/496936
DATED : May 22, 2012
INVENTOR(S) : Taku Ishizawa et al.

It is certified that error appears in the above-identified patent and that said Letters Patent is hereby corrected as shown below:

On the Title Page:

Item [75]: delete “Chiaka Miyajima” and replace with -- Chiaki Miyajima --.

Signed and Sealed this
Tenth Day of July, 2012

David J. Kappos

David J. Kappos
*Director of the United States Patent and Trademark Office*